US008505331B2

(12) United States Patent
Pham et al.

(10) Patent No.: US 8,505,331 B2
(45) Date of Patent: Aug. 13, 2013

(54) FLASH TANK DESIGN AND CONTROL FOR HEAT PUMPS

(75) Inventors: Hung M. Pham, Dayton, OH (US); Jean-Luc M. Caillat, Dayton, OH (US); Ronald L. Van Hoose, Huber Heights, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 151 days.

(21) Appl. No.: 13/032,202

(22) Filed: Feb. 22, 2011

(65) Prior Publication Data

US 2011/0139794 A1 Jun. 16, 2011

Related U.S. Application Data

(60) Continuation of application No. 11/930,889, filed on Oct. 31, 2007, now Pat. No. 8,020,402, which is a division of application No. 11/725,557, filed on Mar. 19, 2007, now abandoned.

(60) Provisional application No. 60/784,145, filed on Mar. 20, 2006.

(51) Int. Cl.
*F25B 43/00* (2006.01)

(52) U.S. Cl.
USPC ..... 62/503; 62/509; 62/512

(58) Field of Classification Search
USPC ..... 62/503, 509, 324.1, 512, 513; 220/565
See application file for complete search history.

(56) References Cited

U.S. PATENT DOCUMENTS

| | | | |
|---|---|---|---|
| 1,958,087 | A | 5/1934 | Hoffman |
| 2,100,867 | A | 11/1937 | Olson |
| 2,570,962 | A | 10/1951 | McBroom |
| 2,811,787 | A | 11/1957 | Raiford |
| 2,859,596 | A | 11/1958 | Evans |
| 2,897,659 | A | 8/1959 | Wergner |
| 3,013,404 | A | 12/1961 | Endress et al. |
| 3,106,096 | A | 10/1963 | Broerman |
| 3,183,896 | A | 5/1965 | Lytle et al. |
| 3,232,074 | A | 2/1966 | Weller et al. |
| 3,553,974 | A | 1/1971 | Osborne |
| 3,611,718 | A | 10/1971 | Nebgen |
| 3,710,554 | A | 1/1973 | Brookman |

(Continued)

FOREIGN PATENT DOCUMENTS

CN 2582713 Y 10/2003

OTHER PUBLICATIONS

International Preliminary Report on Patentability dated Sep. 23, 2008 regarding International Application No. PCT/US2007/006872; Written Opinion of the International Searching Authority dated Sep. 21, 2007 regarding International Application No. PCT/US2007/006872.

(Continued)

*Primary Examiner* — Mohammad M Ali
(74) *Attorney, Agent, or Firm* — Harness, Dickey & Pierce, P.L.C.

(57) ABSTRACT

A flash tank is provided and may include a shell having an inner volume. A first port may be in fluid communication with the inner volume and may be positioned relative to a surface of the inner volume such that fluid flows therebetween in a direction that is substantially tangent to the surface.

45 Claims, 12 Drawing Sheets

(56) References Cited

U.S. PATENT DOCUMENTS

| | | | | |
|---|---|---|---|---|
| 3,738,780 | A | 6/1973 | Edstrom | |
| 3,795,117 | A | 3/1974 | Moody, Jr. et al. | |
| 3,885,402 | A | 5/1975 | Moody, Jr. et al. | |
| 3,913,346 | A | 10/1975 | Moody, Jr. et al. | |
| 4,005,949 | A | 2/1977 | Grant | |
| 4,059,968 | A | 11/1977 | Ross | |
| 4,062,199 | A | 12/1977 | Kasahara et al. | |
| 4,106,307 | A | 8/1978 | Matsuda | |
| 4,107,052 | A * | 8/1978 | Yoshino et al. | 210/534 |
| 4,139,418 | A | 2/1979 | Sech | |
| 4,187,695 | A | 2/1980 | Schumacher | |
| 4,204,410 | A | 5/1980 | Kunz | |
| 4,230,536 | A | 10/1980 | Sech | |
| 4,232,533 | A | 11/1980 | Lundblad et al. | |
| 4,270,937 | A | 6/1981 | Adler et al. | |
| 4,303,594 | A | 12/1981 | Norton et al. | |
| 4,316,366 | A | 2/1982 | Manning | |
| 4,330,307 | A | 5/1982 | Coury | |
| 4,428,328 | A | 1/1984 | Ratliff | |
| 4,466,253 | A | 8/1984 | Jaster | |
| 4,475,360 | A | 10/1984 | Suefuji et al. | |
| 4,478,050 | A * | 10/1984 | DiCarlo et al. | 62/193 |
| 4,509,341 | A | 4/1985 | Zimmern | |
| 4,511,376 | A | 4/1985 | Coury | |
| 4,517,811 | A | 5/1985 | Atsumi et al. | |
| 4,523,435 | A | 6/1985 | Lord | |
| 4,545,742 | A | 10/1985 | Schaefer | |
| 4,609,388 | A | 9/1986 | Adler et al. | |
| 4,622,048 | A | 11/1986 | Roberts et al. | |
| 4,691,533 | A | 9/1987 | Zimmern | |
| 4,706,469 | A | 11/1987 | Oguni et al. | |
| 4,727,725 | A | 3/1988 | Nagata et al. | |
| 4,755,258 | A | 7/1988 | Ryham | |
| 4,861,246 | A | 8/1989 | Zimmern | |
| 4,899,555 | A | 2/1990 | Shaw | |
| 4,903,497 | A | 2/1990 | Zimmern et al. | |
| 4,908,132 | A * | 3/1990 | Koval et al. | 210/446 |
| 4,919,826 | A | 4/1990 | Alzner | |
| 4,947,655 | A | 8/1990 | Shaw | |
| 4,962,647 | A | 10/1990 | Kuwahara | |
| 4,974,427 | A | 12/1990 | Diab | |
| 5,076,067 | A | 12/1991 | Prenger et al. | |
| 5,079,930 | A | 1/1992 | Beaverson et al. | |
| 5,092,911 | A * | 3/1992 | Williams et al. | 95/117 |
| 5,095,712 | A | 3/1992 | Narreau | |
| 5,174,123 | A | 12/1992 | Erickson | |
| 5,189,885 | A | 3/1993 | Ni | |
| 5,214,918 | A | 6/1993 | Oguni et al. | |
| 5,224,354 | A | 7/1993 | Ito et al. | |
| 5,426,956 | A * | 6/1995 | Phillippe | 62/509 |
| 5,447,420 | A | 9/1995 | Caillat et al. | |
| 5,475,985 | A | 12/1995 | Heinrichs et al. | |
| 5,551,253 | A * | 9/1996 | Kim | 62/470 |
| 5,551,255 | A | 9/1996 | Rothfleisch | |
| 5,582,022 | A | 12/1996 | Heinrichs et al. | |
| 5,630,325 | A | 5/1997 | Bahel et al. | |
| 5,640,854 | A | 6/1997 | Fogt et al. | |
| 5,692,389 | A | 12/1997 | Lord et al. | |
| 5,724,830 | A * | 3/1998 | Otis et al. | 62/509 |
| 5,873,255 | A | 2/1999 | Madigan | |
| 5,934,102 | A * | 8/1999 | DeKeuster et al. | 62/509 |
| 5,996,364 | A | 12/1999 | Lifson et al. | |
| 5,996,372 | A | 12/1999 | Koda et al. | |
| 6,032,472 | A | 3/2000 | Heinrichs et al. | |
| 6,070,420 | A | 6/2000 | Biancardi et al. | |
| 6,105,378 | A | 8/2000 | Shaw | |
| 6,128,907 | A * | 10/2000 | Mori | 62/5 |
| 6,167,722 | B1 | 1/2001 | Kasezawa et al. | |
| 6,185,949 | B1 | 2/2001 | Madigan | |
| 6,250,099 | B1 * | 6/2001 | Furuya et al. | 62/473 |
| 6,279,593 | B1 | 8/2001 | Sheppard | |
| 6,334,758 | B1 | 1/2002 | Popov | |
| 6,350,111 | B1 | 2/2002 | Perevozchikov et al. | |
| 6,374,631 | B1 | 4/2002 | Lifson et al. | |
| 6,378,323 | B1 | 4/2002 | Chavagnat | |
| 6,385,980 | B1 | 5/2002 | Sienel | |
| 6,385,981 | B1 | 5/2002 | Vaisman | |
| 6,428,284 | B1 | 8/2002 | Vaisman | |
| 6,430,937 | B2 * | 8/2002 | Cho et al. | 62/5 |
| 6,571,576 | B1 | 6/2003 | Lifson et al. | |
| 6,598,422 | B1 * | 7/2003 | Smith | 62/509 |
| 6,640,561 | B2 | 11/2003 | Roberto | |
| 6,655,172 | B2 | 12/2003 | Perevozchikov et al. | |
| 6,666,041 | B1 * | 12/2003 | Agergaard | 62/174 |
| 6,708,510 | B2 | 3/2004 | Sulc et al. | |
| 6,735,983 | B1 * | 5/2004 | Taru et al. | 65/377 |
| 6,742,356 | B2 | 6/2004 | Saito et al. | |
| 6,745,584 | B2 | 6/2004 | Pham et al. | |
| 6,769,264 | B2 | 8/2004 | Moon et al. | |
| 6,820,434 | B1 | 11/2004 | Gutheim et al. | |
| 6,851,277 | B1 | 2/2005 | Sishtla | |
| 6,883,341 | B1 | 4/2005 | Lifson | |
| 6,938,438 | B2 | 9/2005 | Lifson et al. | |
| 6,939,444 | B2 | 9/2005 | Carlson, Jr. et al. | |
| 6,941,769 | B1 * | 9/2005 | Hill et al. | 62/512 |
| 6,955,059 | B2 | 10/2005 | Lifson et al. | |
| 6,973,794 | B2 | 12/2005 | Street et al. | |
| 6,973,797 | B2 | 12/2005 | Nemit, Jr. | |
| 6,986,264 | B1 | 1/2006 | Taras et al. | |
| 7,114,349 | B2 | 10/2006 | Lifson et al. | |
| 7,137,270 | B2 | 11/2006 | Lifson et al. | |
| 7,201,008 | B2 | 4/2007 | Lifson et al. | |
| 7,204,099 | B2 | 4/2007 | Lifson et al. | |
| 7,272,948 | B2 | 9/2007 | Taras et al. | |
| 7,299,649 | B2 | 11/2007 | Healy et al. | |
| 7,316,120 | B2 | 1/2008 | Aoki et al. | |
| 7,325,411 | B2 | 2/2008 | Bush | |
| 7,360,372 | B2 | 4/2008 | Takechi et al. | |
| 7,380,404 | B2 | 6/2008 | Kang et al. | |
| 7,386,985 | B2 | 6/2008 | Concha et al. | |
| 7,424,807 | B2 | 9/2008 | Sienel | |
| 2001/0032478 | A1 | 10/2001 | McAllister et al. | |
| 2002/0066278 | A1 | 6/2002 | Cho et al. | |
| 2003/0188543 | A1 | 10/2003 | Trecate | |
| 2004/0118150 | A1 | 6/2004 | Yamada et al. | |
| 2005/0044883 | A1 | 3/2005 | Sishtla | |
| 2005/0120733 | A1 | 6/2005 | Healy et al. | |
| 2005/0132729 | A1 | 6/2005 | Manole | |
| 2005/0144976 | A1 | 7/2005 | Sishtla | |
| 2005/0229612 | A1 | 10/2005 | Hrejsa et al. | |
| 2005/0247071 | A1 | 11/2005 | Nemit | |
| 2006/0010899 | A1 | 1/2006 | Lifson et al. | |
| 2007/0175229 | A1 | 8/2007 | Redlich | |
| 2008/0041094 | A1 | 2/2008 | Sienel | |
| 2008/0184721 | A1 | 8/2008 | Crane et al. | |
| 2008/0229782 | A1 | 9/2008 | Takegami et al. | |
| 2009/0007589 | A1 | 1/2009 | Takegami et al. | |

OTHER PUBLICATIONS

First Office Action issued by the State Intellecutal Propety Office regarding Chinese Patent Application 200780010112.3, dated Sep. 11, 2009. English translation provided by Unitalen Attorneys at Law.

Non-Final Office Action for U.S. Appl. No. 11/725,557, dated Feb. 19, 2009.

Non-Final Office Action for U.S. Appl. No. 11/725,557, dated Jun. 22, 2009.

Final Office Action for U.S. Appl. No. 11/725,557, dated Jan. 5, 2010.

Advisory Action for U.S. Appl. No. 11/725,557, dated Mar. 10, 2010.

Non-Final Office Action for U.S. Appl. No. 11/725,557, dated Jul. 22, 2010.

Academic Press Dictionary of Science and Technology, definitions of Flash Process, Receiver, and Flash Tank, retrieved Jun. 10, 2010 from Credo reference database.

Refrigeration & Air Conditioning Technology, 5th Edition, Copyright 2005 Delmar Cengage Learning, Whitman, Johnson, and Tomczyk, pp. 495-496, section describing receivers.

Notification Concerning Availability of the Publication of the International application for PCT/US2007/006872 and Search Report.

Non-Final Office Action for U.S. Appl. No. 11/930,889, dated Sep. 22, 2008.
Non-Final Office Action for U.S. Appl. No. 11/930,889, dated Feb. 25, 2009.
Final Office Action for U.S. Appl. No. 11/930,889, dated Jul. 30, 2009.
Non-Final Office Action for U.S. Appl. No. 11/930,889, dated May 3, 2010.
Final Office Action for U.S. Appl. No. 11/930,889, dated Aug. 12, 2010.
Advisory Action for U.S. Appl. No. 11/930,889, dated Nov. 5, 2010.
Non-Final Office Action for U.S. Appl. No. 11/930,889, dated Feb. 4, 2011.
First Office Action regarding Chinese Patent Application No. 201110130853.3, dated Apr. 27, 2013, including Search Report, dated Apr. 19, 2013. English translation provided by Unitalen Attorneys at Law.

* cited by examiner

FLASH TANK DESIGN AND CONTROL FOR HEAT PUMPS

CROSS-REFERENCE TO RELATED APPLICATIONS

This application is a continuation of U.S. patent application Ser. No. 11/930,889 filed on Oct. 31, 2007, which is a divisional of U.S. patent application Ser. No. 11/725,557 filed on Mar. 19, 2007, which claims the benefit of U.S. Provisional Application No. 60/784,145, filed on Mar. 20, 2006. The disclosures of the above applications are incorporated herein by reference.

FIELD

The present disclosure relates to vapor injection systems and more particularly to an improved flash tank and control scheme for a vapor injection system.

BACKGROUND

Scroll machines include an orbiting scroll member intermeshed with a non-orbiting scroll member to define a series of compression chambers. Rotation of the orbiting scroll member relative to the non-orbiting scroll member causes the compression chambers to progressively decrease in size and cause a fluid disposed within each chamber to be compressed.

During operation, the orbiting scroll member orbits relative to the non-orbiting scroll member through rotation of a drive shaft, which is typically driven by an electric motor. Because the drive shaft is driven by an electric motor, energy is consumed through rotation of the orbiting scroll member. Energy consumption increases with increasing discharge pressure as the scroll machine is required to perform more work to achieve higher pressures. Therefore, if the incoming vapor (i.e., vapor introduced at a suction side of the scroll machine) is at an elevated pressure, less energy is required to fully compress the vapor to the desired discharge pressure.

Vapor injection systems may be used with scroll machines to improve efficiency by supplying intermediate-pressure vapor to the scroll machine. Because intermediate-pressure vapor is at a somewhat higher pressure than suction pressure and at a somewhat lower pressure than discharge pressure, the work required by the scroll machine in producing vapor at discharge pressure is reduced.

Vapor injection systems typically extract vapor at an intermediate pressure from an external device commonly referred to as an economizer such as a flash tank or a heat plate exchanger for injection into a compression chamber of a scroll machine. The flash tank or plate heat exchanger is typically coupled to the scroll machine and a pair of heat exchangers for use in improving system capacity and efficiency. The pair of heat exchangers each serve as a condenser and an evaporator of the system depending on the mode (i.e., cooling or heating).

In operation, the flash tank receives liquid refrigerant from the condenser for conversion into intermediate-pressure vapor and sub-cooled liquid refrigerant. Because the flash tank is held at a lower pressure relative to the inlet liquid refrigerant, some of the liquid refrigerant vaporizes, elevating the pressure of the vaporized refrigerant within the tank. The remaining liquid refrigerant in the flash tank loses heat and becomes sub-cooled for use by the evaporator. Therefore, conventional flash tanks contain both vaporized refrigerant and sub-cooled liquid refrigerant.

The vaporized refrigerant from the flash tank is distributed to an intermediate pressure input port of the scroll machine, whereby the vaporized refrigerant is at a substantially higher pressure than vaporized refrigerant leaving the evaporator, but at a lower pressure than an exit stream of refrigerant leaving the scroll machine. The pressurized refrigerant from the flash tank allows the scroll machine to compress this pressurized refrigerant to its normal output pressure while passing it through only a portion of the scroll machine.

The sub-cooled liquid is discharged from the flash tank and is sent to one of the heat exchangers depending on the desired mode (i.e., heating or cooling). Because the liquid is in a sub-cooled state, more heat can be absorbed from the surroundings by the heat exchanger, improving the overall heating or cooling performance of the system.

The flow of pressurized refrigerant from the flash tank to the scroll machine is regulated to ensure that only vaporized refrigerant or a minimum amount of liquid is received by the scroll machine. Similarly, flow of sub-cooled liquid refrigerant from the flash tank to the heat exchanger is regulated to inhibit flow of vaporized refrigerant from the flash tank to the evaporator. Conventional flash tanks regulate the flow of liquid refrigerant into the flash tank at an inlet of the tank to control the amount of vaporized refrigerant supplied to the scroll machine and sub-cooled liquid refrigerant supplied to the evaporator during one or both of a cooling mode and a heating mode.

SUMMARY

A flash tank is provided and may include a shell having an inner volume. A first port may be in fluid communication with the inner volume and may be positioned relative to a surface of the inner volume such that fluid flows therebetween in a direction that is substantially tangent to the surface.

In another configuration, a flash tank is provided and may include a shell having an inner volume with a height-to-diameter aspect ratio between approximately four and six. A first port may be in fluid communication with the inner volume and may be an inlet in a first mode and may be an outlet in a second mode. A second port may be in fluid communication with the inner volume and may be an outlet in the first mode and may be an inlet in the second mode.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
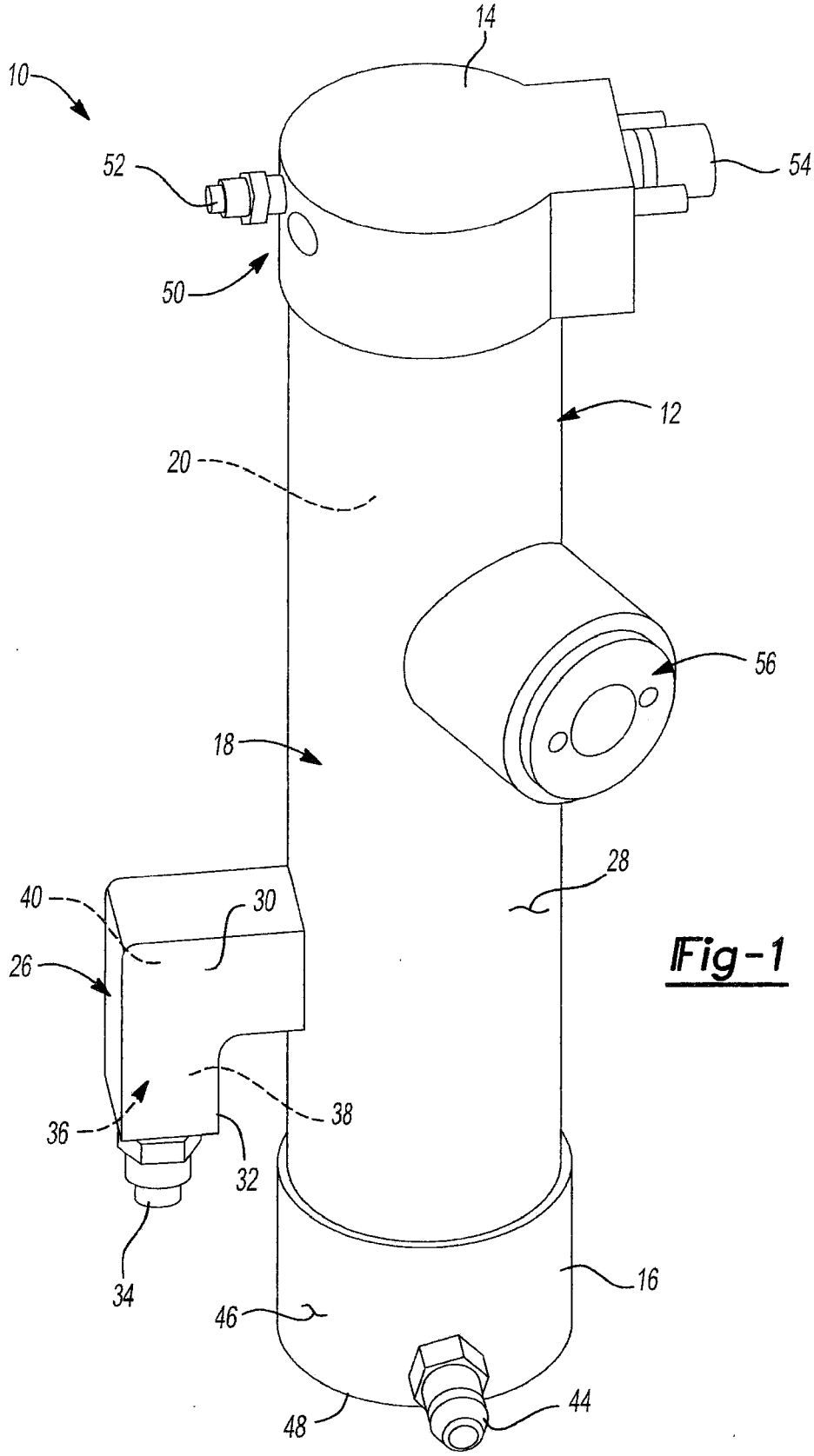
FIG. 1 is a perspective view of a flash tank in accordance with the principles of the present teachings.

The following description is merely exemplary in nature and is not intended to limit the present disclosure, application, or uses.

Vapor injection may be used in air conditioning, chiller, refrigeration, and heat pump systems to improve system capacity and efficiency. Such vapor injection systems may include a flash tank that receives liquid refrigerant and converts the liquid refrigerant into intermediate-pressure vapor and sub-cooled liquid refrigerant. The intermediate-pressure vapor is supplied to a compressor while the sub-cooled liquid refrigerant is supplied to a heat exchanger. Supplying intermediate-pressure vapor to a compressor and sub-cooled liquid refrigerant to a heat exchanger improves the overall system capacity and efficiency of an air conditioning, chiller, refrigeration, and/or heat pump system.

Vapor injection may be used in heat pump systems, which are capable of providing both heating and cooling to commercial and residential buildings, to improve one or both of heating and cooling capacity and efficiency. For the same reasons, flash tanks may be used in chiller applications to provide a cooling effect for water, in refrigeration systems to cool an interior space of a display case or refrigerator, and an air conditioning system to effect the temperature of a room or building. While heat pump systems may include a cooling cycle and a heating cycle, chiller, refrigeration and air conditioning systems often only include a cooling cycle, however, heat pump chillers, which provide heating and cooling cycle, are the norm in some parts of the world. Each system may use a refrigerant to generate the desired cooling or heating effect through a refrigeration cycle.

For air conditioning applications, the refrigeration cycle is used to lower the temperature of a space to be cooled, typically a room or building. For this application, a fan or blower is typically used to force ambient air into more rapid contact with an evaporator to increase heat transfer and cool the surroundings.

For chiller applications, the refrigeration cycle cools or chills a stream of water. Heat pump chillers use the refrigeration cycle to heat a stream of water when operating in a heat mode. Rather than using a fan or blower, the refrigerant remains on one side of the heat exchanger while circulating water or brine provides the heat source for evaporation. Heat pump chillers often use ambient air as the heat source for evaporation during heat mode but may also use other sources such as ground water or a heat exchanger that absorbs heat from the earth. Thus, the heat exchanger cools or heats the water passing therethrough as heat is transferred from the water into the refrigerant on cool mode and from the refrigerant into the water on heat mode.

In a refrigeration system, such as a refrigerator or refrigerated display case, the heat exchanger cools an interior space of the device and a condenser rejects the adsorbed heat. A fan or blower is often used to force the air in the interior space of the device into more rapid contact with the evaporator to increase heat transfer and cooling interior space.

In a heat pump system, the refrigeration cycle is used to both heat and cool. The heat pump system may include an indoor unit and an outdoor unit, with the indoor unit being capable of either heating or cooling a room or an interior space of a commercial or residential building. The heat pump may also be of a monobloc construction with the "outdoor" and "indoor" parts combined in one frame.

While each of the foregoing systems has unique features, vapor injection may be used to improve system capacity and efficiency. Specifically, in each system, a flash tank receiving a stream of liquid refrigerant from a heat exchanger and converting a portion of the liquid refrigerant into vapor, may be used to reduce the amount of work required by the compressor in producing vapor at a desired discharged pressure.

Because the vapor received by the compressor from the flash tank is at an intermediate pressure, which is somewhat higher than suction pressure and somewhat lower than discharge pressure, the amount of work required by the compressor to compress this intermediate-pressure vapor to the desired discharge pressure is reduced as the intermediate-pressure vapor is only required to pass through a portion of the compressor.

The sub-cooled liquid refrigerant created as a by product of the intermediate-pressure vapor increases the overall capacity and efficiency of the system by increasing the efficiency and capacity of an evaporator and a condenser associated with the system. Because the liquid discharged from the flash tank is sub-cooled, when the liquid is supplied to the evaporator, more heat can be adsorbed from the surroundings, thereby increasing the overall performance of the pair of heat exchangers (i.e., condenser and evaporator) in a heating or cooling mode.

With reference to FIGS. 1-8, a flash tank 10 is provided for use with any of the aforementioned systems. The flash tank 10 includes a shell 12 having a top portion 14, a bottom portion 16, and a middle portion 18 extending generally between the top portion 14 and the bottom portion 16. The top portion 14, bottom portion 16, and middle portion 18 cooperate to define an inner volume 20 of the shell 12. The shell preferably includes a height-to-diameter ratio of about four to six to enhance liquid separation by gravity. In one exemplary embodiment, the shell 12 may include a height of 12 inches and a diameter of 2.5 inches, yielding a height-to-diameter aspect ratio of about five. Such a configuration yields an inner volume 20 of about 50 cubic inches, which is effectively sized for a three-ton heat pump based on about 20 percent vapor injection.

Figure 4:
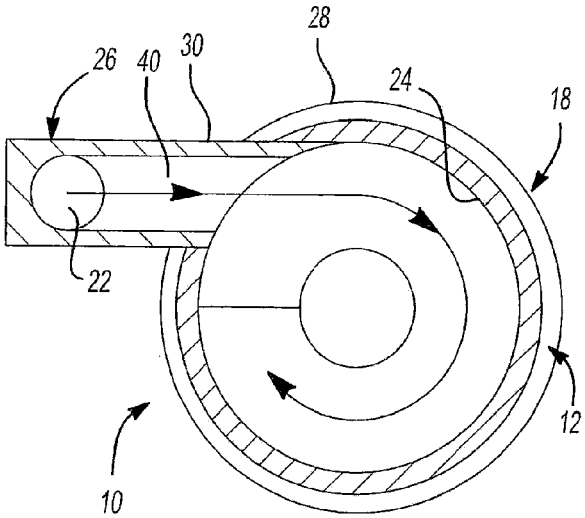
FIG. 4 is a cross-sectional view of the flash tank of FIG. 3 taken along the line 4-4.

The shell 12 includes a first port 22 formed through the middle portion 18 and disposed a distance away from the bottom 16 of the shell 12 approximately equal to one-third of a total height of the shell 12. The first port 22 is in fluid communication with the inner volume 20 and is positioned tangentially to an inner surface 24 of the middle portion 18 such that entering fluid at the first port 22 contacts and flows about the inner surface 24, as best shown in FIG. 4.

An L-shaped elbow 26 is attached to an outer surface 28 of the middle portion 18 and is fluidly coupled to the first port 22. The L-shaped elbow 26 includes a first portion 30 attached to the outer surface 28 of the middle portion 18 and adjacent to the first port 22. The first portion 30 extends from the outer surface 28 such that the first portion 30 is generally perpendicular to the middle portion 18. A second portion 32 of the L-shaped elbow 26 is fluidly coupled to the first portion 30 and extends from the first portion 30 at approximately a ninety degree angle such that the second portion 32 is substantially perpendicular to the first portion 30. Because the second portion 32 is generally perpendicular to the first portion 30, the second portion 32 is spaced apart from, and generally parallel to, the middle portion 18. The second portion 32 includes a fitting 34 disposed at an end of the second portion 32 generally opposite from a connection between the first and second portions 30, 32.

Cooperation between the first portion 30, second portion 32, and fitting 34 provides a fluid passage 36 in communication with the inner volume 20 of the shell 12 via first port 22. The fluid passage 36 includes a first chamber 38 fluidly coupled to the fitting 34 and fluidly coupled to a second chamber 40 of the first portion 30. The second chamber 40 is fluidly coupled to the first port 22 of the shell 12 and includes a greater volume than the first chamber 38. The greater volume of the second chamber 40 allows the second chamber 40 to act as an expansion volume to reduce turbulence associated with a high-velocity expanded refrigerant incoming fluid prior to the fluid reaching the inner volume 20 of the shell 12. The second chamber 40 may also or alternatively include a lesser volume than the first chamber 38, but may include a greater diameter when compared to the first chamber 38 to reduce a velocity of an incoming fluid prior to the fluid reaching the inner volume 20 of the shell 12.

The flash tank 10 further includes a second port 42 disposed generally at the bottom portion 16 of the shell 12. The second port 42 is fluidly coupled to the inner volume 20 of the shell 12 and to a fitting 44. While the fitting 44 is shown generally perpendicular to an outer surface 46 of the bottom portion 16, the fitting 44 may alternatively extend from a bottom surface 48 of the bottom portion 16. Positioning of the fitting 44 on either the side surface 46 or bottom surface 48 of the bottom portion 16 is largely dependent on the configuration of the flash tank 10 and the system to which the flash tank 10 may be coupled.

The flash tank 10 further includes a vapor injection arrangement 50 disposed generally within the top portion 14 of the shell 12. The vapor injection arrangement 50 includes a pressure tap 52 and an outlet 54. The pressure tap 52 provides the flash tank 10 with the ability to measure the pressure of the flash tank (i.e., injection pressure) for the purpose of controlling a liquid level within the flash tank. The outlet 54 is fluidly coupled to the inner volume 20 of the shell 12 for discharging intermediate-pressure vapor stored within an upper portion of the inner volume 20.

In operation, liquid is received generally at the L-shaped elbow 26 and travels along the fluid passage 36 prior to reaching the first port 22. A velocity of the incoming fluid is reduced due to interaction between the fluid and the second chamber 40 of the L-shaped fitting 26. Specifically, when the incoming fluid travels through the first chamber 38 of the L-shaped elbow 26, the fluid makes a substantially ninety degree turn, encountering the second chamber 40. Because the second chamber 40 includes a larger volume and/or larger diameter than the first chamber 38, the entering fluid looses velocity within the second chamber 40, thereby reducing the turbulence associated with the fluid flow.

The fluid encounters the first port 22 upon exiting the second chamber 40 of the L-shaped elbow 26. Because the first port 22 is positioned tangentially relative to the inner surface 24 of the middle portion 18, the flow is caused to travel along the inner surface 24, thereby reducing any remaining turbulence associated with the incoming fluid flow. Once the flow enters the inner volume 20 of the shell 12, the fluid separates by gravity into a sub-cooled liquid and an intermediate-pressure vapor as the flash tank 10 is held at a lower pressure relative to the inlet liquid. The sub-cooled liquid collects generally at the bottom portion 16 of the shell 12 while the intermediate-pressure vapor collects near a top portion 14 of the shell 12.

In one exemplary embodiment, the level of sub-cooled liquid disposed with the inner volume 20 of the shell 12, is maintained at a height substantially equal to two-thirds of a total tank height such that the upper one-third of the shell 12 contains intermediate-pressure vapor. Maintaining the sub-cooled liquid level within the interior volume 20 of the shell 12 may be accomplished through use of either a sight glass 56 or a liquid-level sensor 58 or by regulating the flash tank flow controls using a parameter such as the injection pressure or the compressor discharge temperature. If a sight glass 56 is used to monitor the liquid level of the sub-cooled liquid within the shell 12, the sight glass 56 is preferably disposed near a desired level of liquid in the shell 12. As described above, one such preferred liquid level is approximately equal to two-thirds of a total height of the shell 12. Therefore, placing the sight glass 56 at approximately two-thirds of the total tank height of the shell 12 allows for determination of a level of sub-cooled liquid disposed within the inner volume 20.

If a liquid-level sensor 58 is used either in conjunction with, or in place of, the sight glass 56, the liquid-level sensor 58 may be positioned at the desired liquid level with the inner volume 20 of the shell 12 to allow for determination of the liquid level within the inner volume 20. Additional liquid-level sensors 58 may also be used within the inner volume 20 of the shell 12 to determine an exact sub-cooled liquid level within the interior volume to provide specific liquid level data if the liquid within the inner volume 20 exceeds the desired liquid level or drops below a low-limit threshold.

As described above, the incoming fluid entering the flash tank 10 is typically turbulent. The turbulence associated with the incoming fluid reduces the ability of the flash tank 10 to adequately separate into the sub-cooled liquid and the intermediate-pressure vapor. Therefore, reducing the turbulence of the incoming fluid improves the ability of the flash tank 10 to separate the fluid into sub-cooled liquid and intermediate-pressure vapor. While the expansion volume of the second chamber 40 and the positioning of the first port 22 relative to the inner surface 24 of the middle portion 18 (i.e., tangential to the inner surface 24) reduces the turbulence associated with the incoming fluid, additional measures may be taken to further control the incoming fluid.

Figure 2:
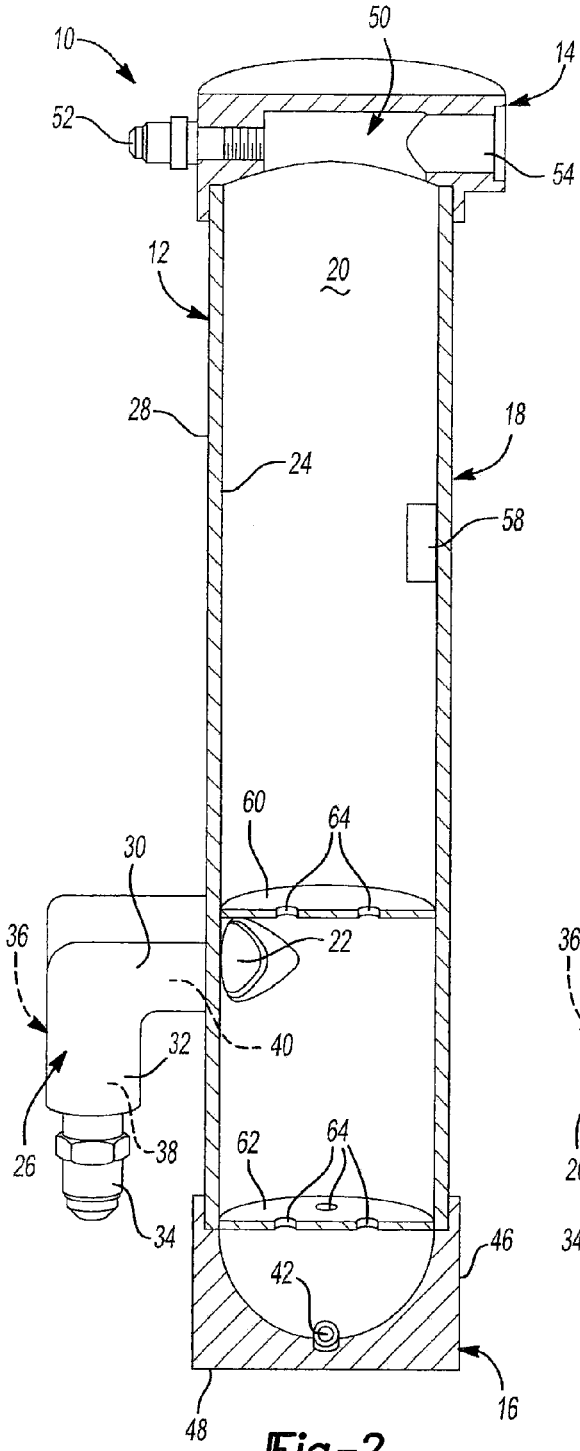
FIG. 2 is a cross-sectional view of a flash tank in accordance with the principles of the present teachings incorporating a baffle arrangement.

With particular reference to FIG. 2, the flash tank 10 is shown to include an upper baffle 60 and a lower baffle 62. The upper baffle 60 is positioned generally above the first port 22 and includes a series of apertures 64 to allow communication between the bottom portion 16 of the shell 12 and the top portion 14 of the shell 12. The lower baffle 62 is located generally adjacent to the bottom portion 16 of the shell 12 and similarly includes a series of apertures 64.

The apertures 64 of the lower baffle 62 allow communication between the first port 22 and the second port 42 to allow any sub-cooled liquid disposed generally above the lower baffle 62 to travel through the various apertures 64 of the lower baffle 62 and exit the shell 12 at the second port 42. The upper and lower baffles 60, 62 cooperate to confine the incoming flow generally between the upper and lower baffles 60, 62. Therefore, any turbulence associated with the incoming liquid is generally confined and does not disturb the vapor near the top portion 14 of the shell 12.

For example, if the top portion 14 of the shell 12 includes intermediate-pressure vapor, the upper baffle 60 prevents fluid entering the shell 12 at the first port 22 from sloshing sub-cooled liquid above the upper baffle 60 and therefore prevents mixture of the sub-cooled liquid with the intermediate-pressure vapor. Without the upper baffle 60, the incoming fluid may cause the sub-cooled liquid disposed within the inner volume 20 of the shell 12 to mix with the intermediate-pressure vapor and therefore may cause the vapor injection arrangement 50 to supply intermediate-pressure vapor mixed with sub-cooled liquid and incoming liquid at the outlet 54 of the vapor injection arrangement 50. Such a mixture is desirable in a minimal quantity (i.e., approximately 5% liquid and 95% vapor), but in excess can adversely affect the durability of a compressor to which the vapor injection arrangement 50 may be coupled. Therefore, cooperation between the upper baffle 60 and lower baffle 62 improves the overall function of the flash tank 10 by allowing the flash tank 10 to more efficiently and more effectively separate the incoming fluid to sub-cooled liquid and intermediate-pressure vapor.

Figure 3:
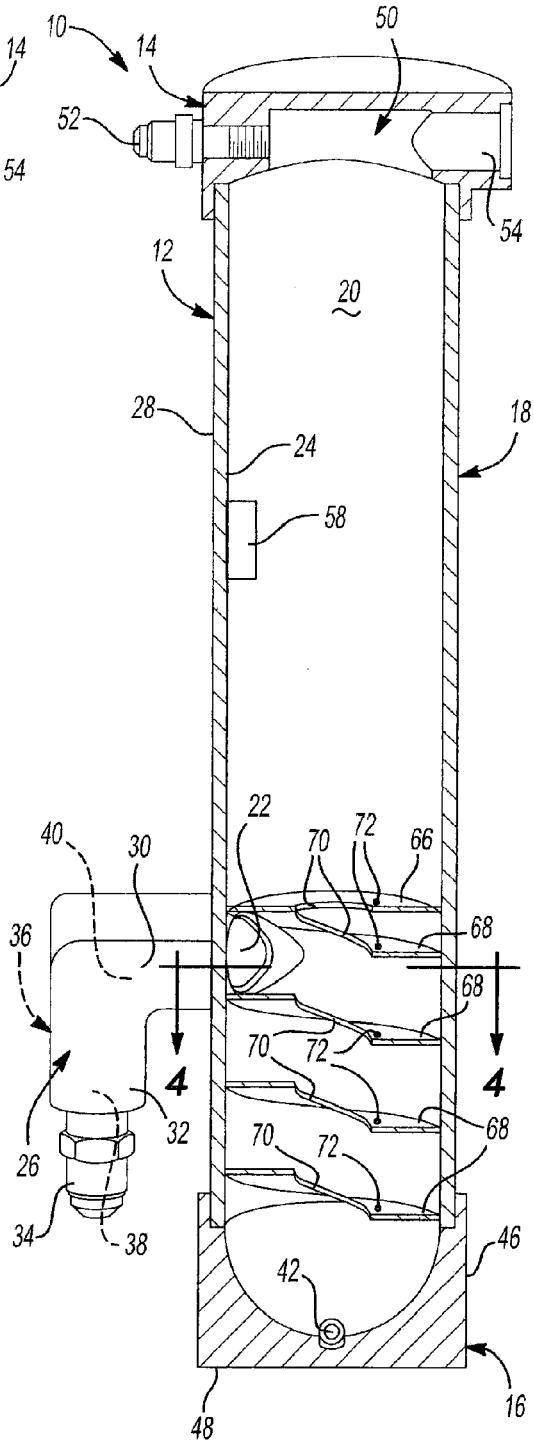
FIG. 3 is a cross-sectional view of a flash tank in accordance with the principles of the present teachings incorporating a baffle arrangement.

With particular reference to FIG. 3, the flash tank 10 is shown to include an upper baffle 66 and a series of angled baffles 68. The upper baffle 66 is positioned within the inner volume 20 of the shell 12 such that the upper baffle 66 is generally perpendicular to the inner surface 24 of the middle portion 18. The upper baffle 66 may include a central aperture 70 and/or a series of smaller apertures 72 to allow communication between the bottom portion 16 of the shell 12 and the top portion 14 of the shell 12. The angled baffles 68 extend downward from the upper baffle 66 and are positioned at an angle relative to the upper baffle 66. Each of the angled baffles 68 include the central aperture 70 extending therethrough and may additionally or alternatively include a series of smaller apertures 72. Again, as with the upper baffle 66, the central aperture 70 and/or smaller apertures 72 provide fluid communication through the angled baffles 68 such that fluid communication between the bottom portion 16 of the shell 12 and the top portion 14 of the shell 12 is achieved.

As previously described, turbulence associated with incoming fluid can adversely affect the performance of the flash tank 10 in separating the incoming fluid into sub-cooled liquid and intermediate-pressure vapor. The upper baffle 66 and angled baffles 68 cooperate to reduce this turbulence associated with the incoming fluid. Specifically, when the fluid is introduced at the first port 22 of the shell 12, the fluid engages the inner surface 24 of the middle portion 18 due to the tangential relationship between the first port 22 and the inner surface 24, as previously discussed. The tangential relationship between the first port 22 and the inner surface 24 causes the incoming fluid to engage the inner surface 24 and travel around the inner surface 24, as best shown in FIG. 4. Cooperation between the upper baffle 66 and the angled baffles 68 further enhances the flow of the incoming fluid about the inner surface 24 of the middle portion 18 and away from the upper baffle 66.

Specifically, as the incoming fluid exits the first port 22 and engages the inner surface 24 of the middle portion 18, the fluid is restricted from flowing generally upwards within the inner volume 20 of the shell 12 by the upper baffle 66. Therefore, the fluid is caused to continue traveling along the inner surface 24 of the middle portion 18 and is caused to actually move downward within the inner volume 20 of the shell 12 due to the position of the angled baffles 68. In this manner, the upper baffle 66 cooperates with the angled baffles 68 to reduce the turbulence associated with the incoming fluid and to direct the incoming fluid towards the bottom portion 16 of the shell 12 and away from the intermediate-pressure vapor stored at the top portion 14 of the shell 12. Therefore, the upper baffle 66 and the angled baffles 68 cooperate to increase the ability of the flash tank 10 to separate incoming fluid into sub-cooled liquid and intermediate-pressure vapor and, therefore, improve the overall performance of the flash tank 10.

Figure 5:
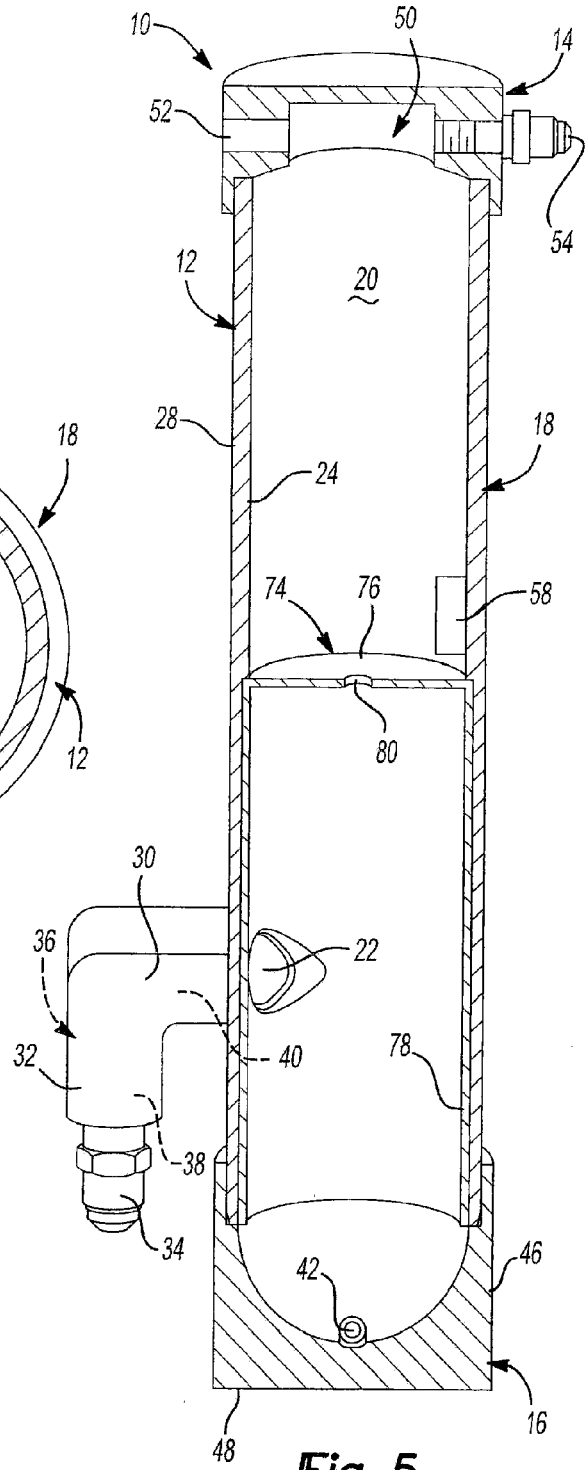
FIG. 5 is a cross-sectional view of a flash tank in accordance with the principles of the present teachings incorporating an internal shell including a top disk having an aperture formed therethrough to allow fluid communication between a top portion of the flash tank and a bottom portion of the flash tank.
Figure 6:
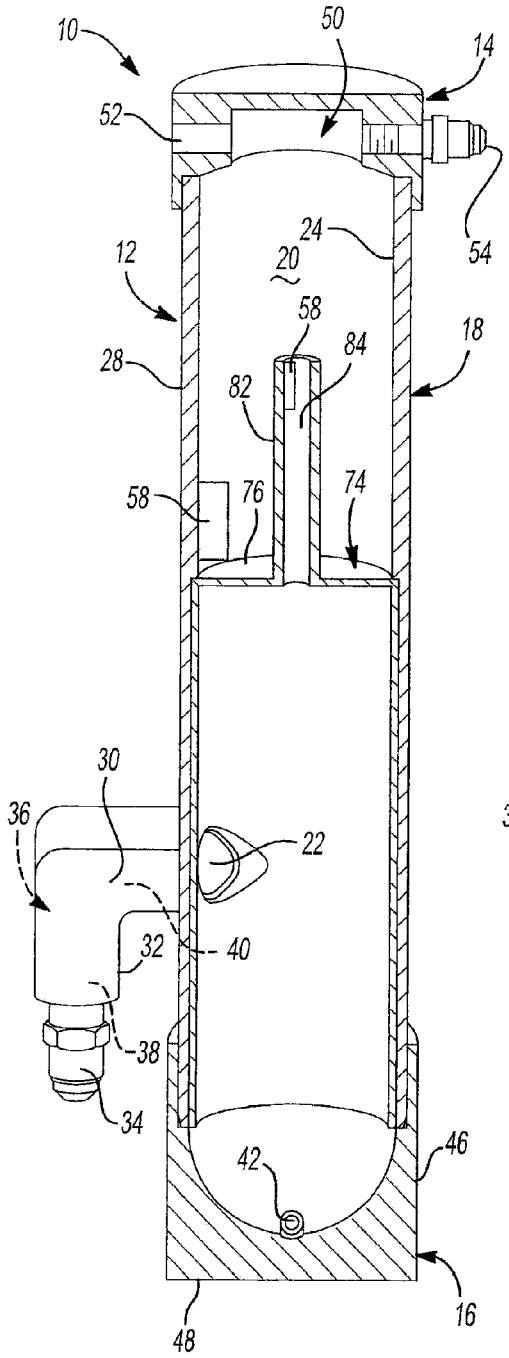
FIG. 6 is a cross-sectional view of the flash tank in accordance with the principles of the present teachings incorporating an internal shell including a top disk having a tube formed thereon to allow fluid communication between a top portion of the flash tank and a bottom potion of the flash tank.
Figure 7:
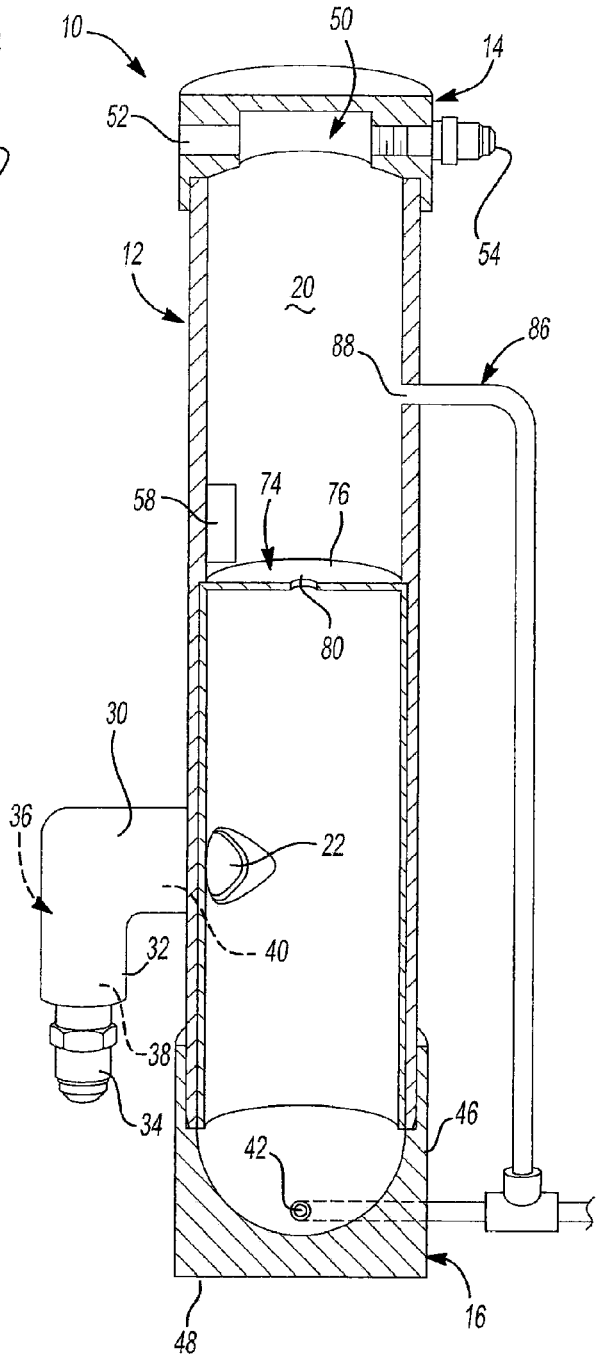
FIG. 7 is a cross-sectional view of a flash tank in accordance with the principles of the present teachings incorporating an internal shell having a top disk portion including an aperture formed therethrough and a recirculation tube in communication with the top portion of the tank to maintain a liquid level within the flash tank at a predetermined level.

With particular reference to FIGS. 5-7, the flash tank 10 is shown to include an inner shell 74. As described previously with regard to the baffles 60, 62, 66, and 68, reducing turbulence associated with the incoming fluid and improving the ability of the flash tank 10 to separate the incoming fluid into sub-cooled liquid and intermediate-pressure vapor, improves the overall efficiency and performance of the flash tank 10. The inner shell 74 cooperates with the second chamber 40 of the L-shaped elbow 26, and the tangential relationship between the first port 22 and the inner surface 24 of the middle portion 18, to further improve the ability of the flash tank 10 to prevent the sub-cooled and entering liquid from mixing with the intermediate-pressure vapor.

With particular reference to FIG. 5, the inner shell 74 is shown to include a top disk 76 formed generally perpendicular to the middle portion 18 and a cylindrical body 78 extending from a bottom portion of the top disk 78 towards the bottom portion 16 of the shell 12. The top disk 76 may be in contact with the inner surface 24 of the middle portion 18 such that fluid communication between the bottom portion 16 of the shell 12 and the top portion 14 of the shell 12 is not permitted between the junction of the top disk 76 and the inner surface 24 of the middle portion 18. Rather, fluid communication between the bottom portion 16 and the top portion 14 is controlled through an aperture 80 formed in the top disk 76. The aperture 80 allows vapor, which is created from the entering fluid at the first port 22, to escape from an area generally below the top disk 76 and toward the top portion 14 of the shell 12. While the aperture 80 allows the intermediate-pressure vapor to escape through the top disk 76 toward the top portion 14 of the shell 12, the top disk 76 restricts incoming fluid at the first port 22 and sub-cooled liquid disposed within the bottom portion 16 from reaching the intermediate-pressure vapor stored at the top portion 14 of the shell 12.

The entering fluid at the first port 22 typically includes at least some turbulent flow, as previously discussed. Because the velocity and turbulence of the incoming fluid is not completely eliminated by the second chamber 40 of the L-shaped elbow 26 and the tangential relationship between the first port 22 and the inner surface 24 of the middle portion 18, the incoming fluid may mix with the sub-cooled liquid and may cause the incoming liquid to slosh within the inner volume 20 of the shell 12, thereby causing the fluid and/or the sub-cooled liquid already disposed within the inner volume 20 to slosh within the inner volume 20 and move generally toward the top portion 14 of the shell 12. Because the top disk 76 only includes the aperture 80, most of the fluid and/or sub-cooled liquid is restricted from reaching into the top portion 14 of the shell 12 and mixing with the intermediate-pressure vapor. Therefore, the top disk 76 effectively allows fluid communication between the bottom portion 16 of the shell 12 and the top portion 14 of the shell 12, while improving the ability of the flash tank 10 to maintain the intermediate-pressure vapor separate from the sub-cooled liquid and incoming fluid at the first port 22. Therefore, the top disk 76 improves the overall performance and efficiency of the flash tank 10 in separating the incoming fluid into intermediate-pressure vapor and sub-cooled liquid and in maintaining this separation.

While the top disk 76 has been described as including a single aperture 80, the top disk 76 may include a plurality of apertures formed therethrough to tailor the fluid flow between the bottom portion 16 of the shell 12 and the top portion 14 of the shell 12. The top disk 76 may be positioned at any height within the inner volume 20 of the shell 12, but is preferably positioned such that the top disk 76 is at the desired tank liquid level. In one exemplary embodiment, the desired sub-cooled liquid disposed within the inner volume 20 of the shell 12 is substantially equivalent to two-thirds of the total height of the shell 12. Therefore, the inner shell 74 may be positioned relative to the shell 12 such that the top disk 76 is located approximately at two-thirds of the total height of the shell 12.

With particular reference to FIG. 6, the flash tank 10 is shown including the inner shell 74 having a tube 82 extending from the top disk 76. The tube 82 allows fluid communication between the bottom portion 16 of the shell 12 and the top portion 14 of the shell 12, and includes a central bore 84 extending along the length of the tube 82. The tube 82 prevents the incoming fluid and/or sub-cooled liquid from reaching the top portion 14 of the shell 12 and mixing with the intermediate-pressure vapor stored within the top portion 14.

Because movement of the incoming fluid into the bottom portion 16 of the shell 12 is generally a turbulent flow such that the incoming fluid and/or sub-cooled liquid sloshes within the bottom portion 16, the incoming fluid and/or sub-cooled liquid generally rises and falls within the inner volume 20. Therefore, the fluid and/or sub-cooled liquid may rise at the localized aperture 80 formed in the top disk 76 and actually reach the top portion 14 of the shell 12.

The tube 82 allows the rising fluid and/or sub-cooled liquid to rise and extend into the bore 84 of the tube 82 without actually reaching and mixing with the intermediate-pressure vapor. Therefore, by providing the top disk 76 with the tube 82, mixing of incoming fluid at the first port 22 and/or sub-cooled liquid with the intermediate-pressure vapor at the top portion 14 of the shell 12 is restricted to a desired mixing of "wet" injection (i.e., 5% liquid, as noted above).

With particular reference to FIG. 7, the flash tank 10 is shown to include the inner shell 74 incorporating aperture 80 and a overflow recirculation tube 86. As described above with respect to FIG. 5, the aperture 80 allows fluid communication between the bottom portion 16 of the shell 12 and the top portion 14 of the shell 12 while reducing the likelihood of mixing between incoming fluid and/or sub-cooled liquid with the intermediate-pressure vapor stored within the top portion 14. However, if the incoming liquid at the first port 22 has an excessive velocity or excess liquid refrigerant charge such that a turbulent flow is created within the inner volume 20 of the shell 12 is created, or the volume of incoming fluid and/or sub-cooled liquid exceeds a predetermined volume, the incoming fluid and/or sub-cooled liquid disposed within the inner volume 20 may rise within the inner volume 20 and encounter the aperture 80 such that incoming fluid and/or sub-cooled liquid passes through the aperture 80 and into the top portion 14 of the shell 12.

If the liquid and/or sub-cooled liquid passes through the aperture 80 and enters the top portion 14 of the shell 12, the liquid and/or sub-cooled liquid may mix with the intermediate-pressure vapor and be drawn from the inner volume 20 of the shell 12 by the vapor injection arrangement 50 at outlet 54, potentially causing damage to a compressor to which the flash tank 10 may be coupled.

The overflow recirculation tube 86 passes through the middle portion 18 of the shell 12 and is positioned generally above the aperture 80 of the top disk 76. The overflow recirculation tube 86 includes a fluid passage 88 that is fluidly coupled to the second portion 42 of the shell 12. If the incoming fluid and/or sub-cooled liquid flows through the aperture 80, passing through the top disk 76 of the inner shell 74, the fluid and/or sub-cooled liquid will be collected by the overflow recirculation tube 86 and mixed with the exiting sub-cooled liquid at the second port 42 via fluid passage 88 to prevent mixing of incoming fluid and/or sub-cooled liquid with intermediate-pressure vapor. Cooperation between the overflow recirculation tube 86 and the aperture 80 collects any fluid and/or sub-cooled liquid that may escape through the top disk 76 and redirects the fluid and/or sub-cooled liquid away from the top portion 14 of the shell 12 and, thus, away from the vapor injection arrangement 50.

While the inner shell 74 has been described as preventing incoming fluid and/or sub-cooled liquid from sloshing from the bottom portion 16 of the shell 12 to the top portion 14 of the shell 12, the inner shell 74 also improves the ability of the flash tank 10 in separating incoming fluid into intermediate-pressure vapor and sub-cooled liquid by maintaining the sub-cooled liquid within the shell 12 at a height approximately equal to two-thirds of the total height of the shell 12. This is accomplished by positioning the top disk 76 within the inner volume 20 at a height approximately equal to two-thirds of the total height of the shell 12.

Figure 8:
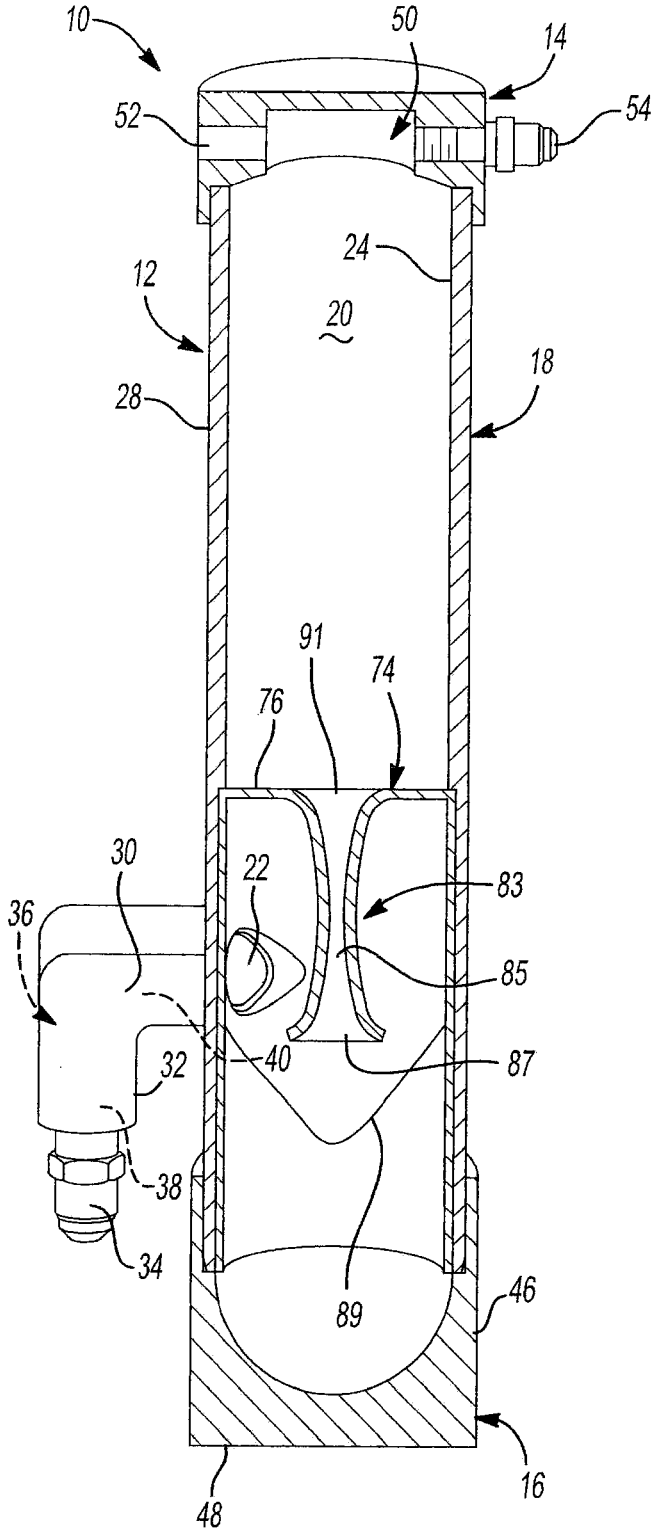
FIG. 8 is a cross-sectional view of the flash tank in accordance with the principles of the present teachings incorporating an internal shell including a top disk having a tube formed thereon to allow fluid communication between a top portion of the flash tank and a bottom potion of the flash tank.

With particular reference to FIG. 8, the flash tank 10 is shown including the inner shell 74 having a tube 83 extending from the top disk 76 generally toward the bottom portion 16 of the shell 12. The tube 83 allows fluid communication between the bottom portion 16 of the shell 12 and the top portion 14 of the shell 12, and includes a central bore 85 extending along the length of the tube 83 and a bell-mouth opening 87. The tube 83 prevents the incoming fluid and/or sub-cooled liquid from reaching the top portion 14 of the shell 12 and mixing with the intermediate-pressure vapor stored within the top portion 14.

Movement of the incoming fluid into the bottom portion 16 of the shell 12 is generally along the inner surface 24 of the shell 18 due to the tangential relationship between the first port 22 and the shell 18. Interaction between the incoming fluid and the inner surface 24 causes the incoming flow to form a vortex (schematically represented as 89 in FIG. 8) within the shell 18. The tube 83 is positioned generally within the vortex 89 such that the incoming fluid swirls around the bell-mouth opening 87 and does not enter the central bore 85.

As described above, the incoming fluid is separated into a sub-cooled liquid and intermediate-pressure vapor. The positioning of the tube 83, in combination with the bell-mouth opening 87 and a diffuser 91 positioned on an opposite end of the tube 83 from the bell-mouth opening 87, cooperate to transfer intermediate-pressure vapor from the bottom portion 16 of the shell 12 to the top portion 14 of the shell 12 (i.e., through the top disk 76) without causing a drop in pressure. Therefore, the tube 83, bell-mouth opening 87, and diffuser 91, provide a low-pressure drop passage that allows fluid communication between the bottom portion 16 of the shell 12 and the top portion 14 of the shell 12 without reducing a pressure of the intermediate-pressure vapor as the intermediate-pressure vapor travels from the bottom portion 16 of the shell 12 to the top portion 14 of the shell 12.

By providing the top disk 76 with the tube 83, mixing of incoming fluid at the first port 22 and/or sub-cooled liquid with the intermediate-pressure vapor at the top portion 14 of the shell 12 is restricted to a desired mixing of "wet" injection (i.e., 5% liquid, as noted above).

Figure 9:
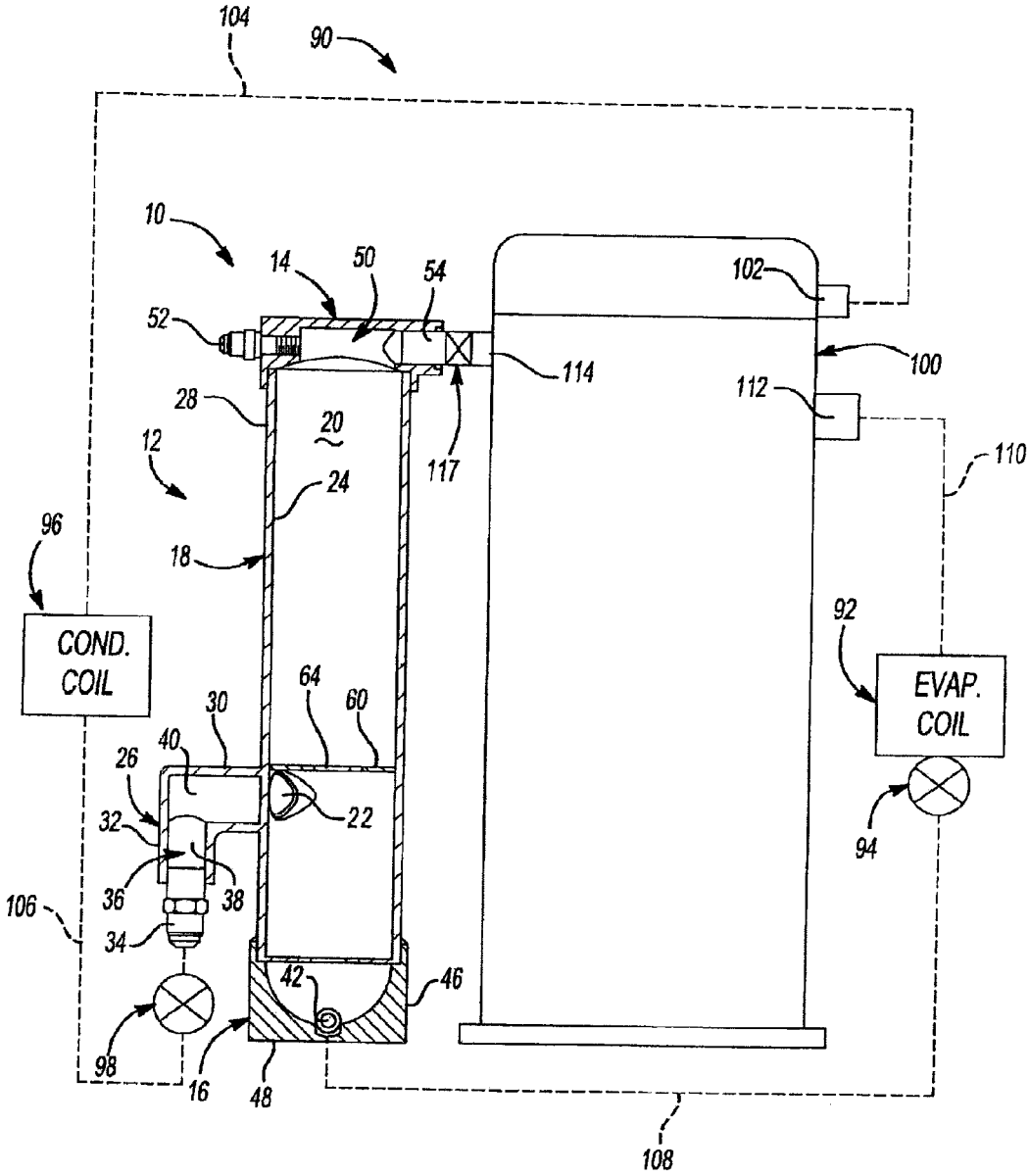
FIG. 9 is a schematic view of a cooling or refrigeration system including a flash tank fluidly coupled to a compressor.

With particular reference to FIG. 9, the flash tank 10 is shown incorporated into a refrigeration or cooling system 90 including an evaporator 92, a first expansion device 94, a condenser 96, and second expansion device 98. Each of the components of the refrigeration circuit 90 are fluidly coupled to a compressor 100 that circulates a fluid between the individual components.

In operation, vapor at discharge pressure is produced by the compressor 100 and exits the compressor 100 generally at a discharge fitting 102. The vapor, at discharge pressure, travels along a conduit 104 and enters the condenser 96. Once in the condenser 96, the discharge-pressure vapor changes phase from a high-pressure vapor to a liquid by rejecting heat. Once the high-pressure vapor has been converted to a liquid, the liquid exits the condenser 96 and travels along a conduit 106 toward the second expansion device 98. The second expansion device expands the liquid prior to the refrigerant reaching the fitting 34 of the flash tank 10. The expanded liquid enters the flash tank 10 generally at the fitting 34 and encounters the L-shaped elbow 26 and the first port 22.

As described above, the entering fluid first encounters the first chamber 38 of the L-shaped elbow 26 and then encounters the second chamber 40 of the L-shaped elbow 26 to reduce the velocity of the incoming fluid prior to the fluid reaching the first port 22. Once the incoming fluid exits the second chamber 40 the L-shaped elbow 26, the fluid passes through the first port 22 and is caused to engage the inner surface 24 of the middle portion 18 due to the tangential relationship between the first port 22 and the inner surface 24 of the middle portion 18. The incoming fluid travels along the inner surface 24 of the middle portion 18 and is prevented from rising within the shell 12 by the upper baffle 60.

Once the fluid is disposed within the bottom portion 16 of the shell 12, the fluid is separated into sub-cooled liquid and intermediate-pressure vapor. The sub-cooled liquid collects generally at the bottom portion 16 of the shell 12 while the intermediate-pressure vapor travels upwardly within the inner volume 20 through the aperture 64 of the upper baffle 60 and into the top portion 14 of the shell 12.

The sub-cooled liquid disposed within the bottom portion 16 of the shell 12, exits the inner volume 20 via the second port 42. The exiting sub-cooled liquid exits the second port 42 via fitting 44 and travels along a conduit 108 extending generally between the second port 42 of the flash tank 10 and the expansion device 94 located upstream of the evaporator 92. The sub-cooled liquid travels along the conduit 108 and passes through the expansion device 94. The sub-cooled liquid is expanded by the expansion device 94 and enters the evaporator 92 following expansion. Once in the evaporator 92, the sub-cooled liquid changes phase from a liquid to a vapor, thereby producing a cooling effect.

Once the sub-cooled liquid changes phase from a liquid to a vapor, the vapor exits the evaporator 92 and travels along a conduit 110, extending generally between the evaporator 92 and a suction port 112 of the compressor 100. The vapor is drawn from the conduit 110 and enters the compressor 100 at the suction port 112. Once the vapor reaches the compressor 100, the cycle begins anew and the compressor pressurizes the entering vapor to discharge pressure prior to dispensing the vapor at discharge pressure at discharge fitting 102.

The intermediate-pressure vapor disposed within the top portion 14 of the shell 12 is fed to the compressor 100 via the vapor injection arrangement 50. Specifically, the intermediate-pressure vapor is supplied to an injection port 114 of the compressor 100 at the outlet 54 of the vapor injection arrangement 50. The intermediate-pressure vapor, as described above, is at a lower pressure than discharge pressure but at a higher pressure than the vapor received at the suction port 112 of the compressor 100 (i.e., suction pressure). The intermediate-pressure vapor is injected at the injection port 114 and is only required to pass through a portion of the compressor 100 to reach discharge pressure due to its elevated pressure relative to suction pressure. Therefore, the work required by the compressor 100 in producing vapor at discharge pressure is reduced. By reducing the amount of work required by the compressor 100 in producing vapor at discharge pressure, energy associated with operation of the compressor 100 is reduced and the overall efficiency of the system 90 is improved. A solenoid valve 117 may be disposed and fluidly coupled near the injection port 114 to selectively close or open the injection flow as desired for capacity control.

With particular reference to FIG. 9, the flash tank 10 is shown incorporated into a heat pump system 116 capable of operating in a heating mode and a cooling mode. The heat pump system 116 includes a compressor 118 fluidly coupled to an indoor heat exchanger 120 and an outdoor heat exchanger 122. A four-way reversing valve 124 is disposed generally between the compressor 118 and the indoor and outdoor heat exchangers 120, 122 to direct fluid flow within the system 116. Specifically, when the four-way reversing valve 124 directs fluid from the compressor 118 towards the inner heat exchanger 120, the heat pump system 116 operates in the heating mode and when the four way reversing valve 124 directs fluid flow from the compressor 118 towards the outdoor heat exchanger 122, the heat pump system 116 operates in the cooling mode.

A check valve 126 and a control device 128 are associated with the indoor heat exchanger 120. The control device 128 may be either a thermal expansion valve, an electronic expansion valve, or a fixed orifice. If the control device 128 is a thermal expansion valve, a pressure tap 130 and a bulb 132 may be fluidly coupled on an opposite side of the indoor heat exchanger 120 from the thermal expansion valve 128 for use in controlling the thermal expansion valve 128. While the check valve 126 and control device 128 are shown as separate and discrete elements, the check valve 126 and control device 128 may be a single integrated unit commercially available provided in fluid communication with the indoor heat exchanger 120.

The outdoor heat exchanger 122 similarly includes a check valve 134 and a control device 136. The control device 136 may be a thermal expansion valve, an electronic expansion valve, or a fixed orifice. If the control device 136 is a thermal expansion valve, a pressure tap 138 and bulb 140 may be positioned on an opposite side of the outdoor heat exchanger 122 from the thermal expansion valve 136 for use in controlling the thermal expansion valve 136. While the check valve 134 and control device 136 are shown as separate elements, the check valve 134 and control device 136 could be included as a single integrated unit commercially available fluidly coupled to the outdoor heat exchanger 122.

If either of the control devices 128, 136 respectively associated with the indoor heat exchanger 120 and the outdoor heat exchanger 122 is a fixed orifice or a capillary tube, an accumulator 142 should be provided. Because a fixed orifice and a capillary tube cannot be adjusted for heating or cooling load variation, the accumulator 142 may be required to keep a reserve of refrigerant in fluid communication with the compressor 118 and heat exchangers 120, 122 in case the load causes excessive refrigerant to return to a suction side of the compressor. Therefore, if a fixed orifice or a capillary tube is to be used for either of the control devices 128, 136 associated with the indoor heat exchanger 120 or the outdoor heat exchanger 122, the accumulator 142 may be required.

The flash tank 10 is shown fluidly coupled to the compressor 118, the indoor heat exchanger 120, and the outdoor heat exchanger 122. A check valve 144 and a control device 146 are disposed generally between the flash tank 10, the check valve 126, and the control device 128 of the indoor heat exchanger 120. The control device 146 may be a thermal expansion device, an electronic expansion device, or a fixed orifice. If the control device 146 is a thermal expansion device, a pressure tap 147 and bulb 149 can be fluidly coupled to the conduit 156 right after the second port 44 of the flash tank 10. Again, while the check valve 144 and control device 146 are shown as separate elements, the check valve 144 and control device 146 may be configured as a single unit fluidly coupled between the check valve 126 and control device 128 associated with the indoor heat exchanger 120 and the flash tank 10.

The vapor injection arrangement 50 of the flash tank 10 is fluidly coupled to a vapor injection port 148 of the compressor 118 to selectively supply the compressor 118 with intermediate-pressure vapor during operation of the heat pump system 116. A solenoid valve 150 is disposed generally between the outlet 54 of the vapor injection arrangement 50 and the vapor injection port 148 of the compressor 118. The solenoid valve 150 may be a solenoid valve or any suitable device for use in controlling injection flow to the compressor 118 to control capacity as needed. The solenoid valve 150 is preferably located as close as possible to the injection port 148 of the compressor 118 to minimize compressed gas re-expansion loss.

While a fixed orifice is described as being an option for the control devices 128, 146, the fixed orifice could alternatively be a capillary tube. Furthermore, while the control devices 128, 146 are described generically as being electronic expansion valves, such electronic expansion valves may include stepper-motor-driven solenoids or pulse-width modulated solenoids.

Figure 10:
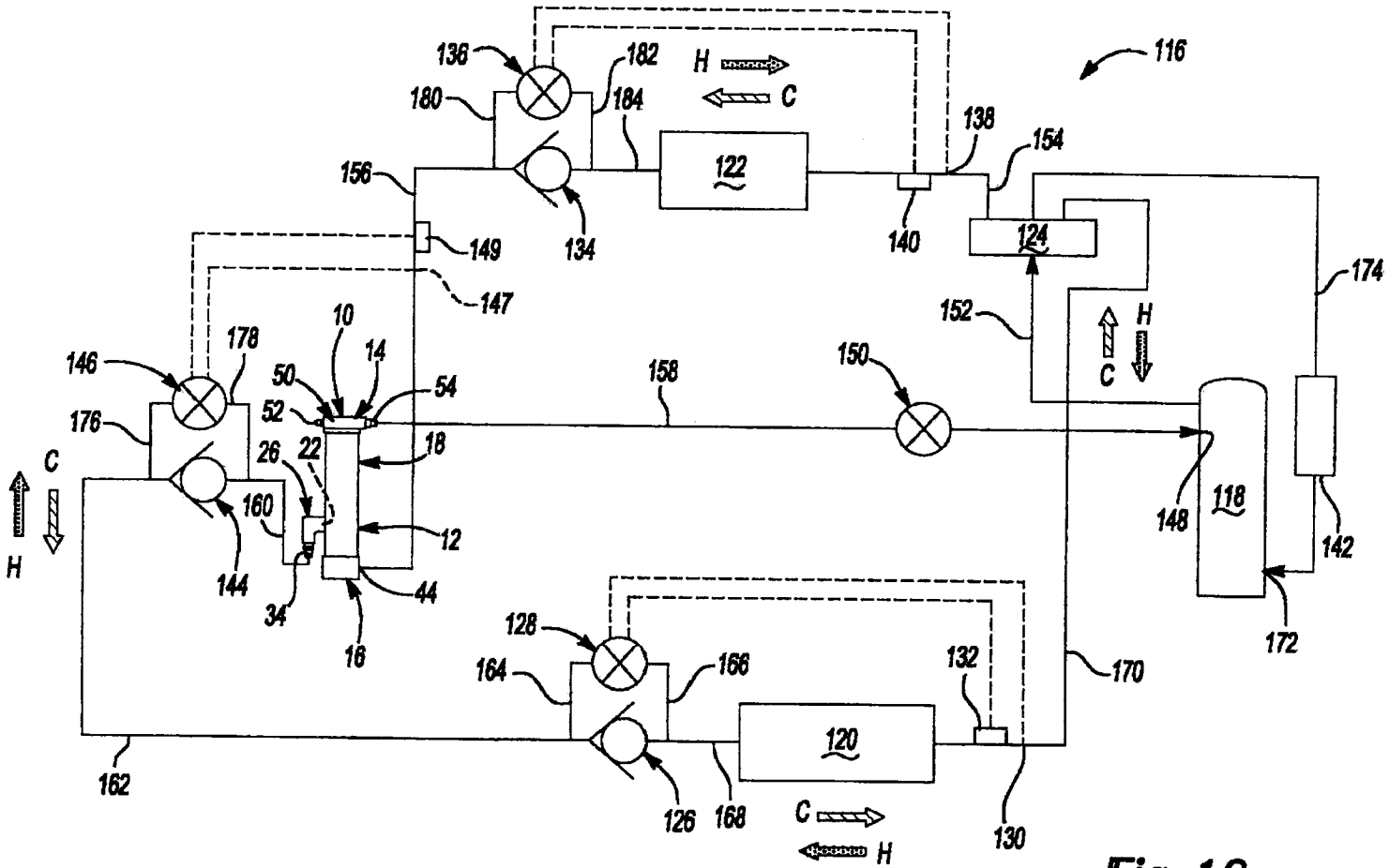
FIG. 10 is a schematic view of a heat pump system incorporating a flash tank.

With reference to FIG. 10, operation of the heat pump system 116 will be described in detail. As previously discussed, the heat pump system 116 is operable in a heating mode and a cooling mode. The flash tank 10 selectively provides intermediate-pressure vapor to the vapor injection port 148 of the compressor 118 in the heating mode by opening solenoid valve 150. In the cooling mode, the flash tank 10 acts as a receiver by closing solenoid valve 150, whereby intermediate-pressure vapor is prevented from reaching the vapor injection port 148 of the compressor 118. The liquid refrigerant is slightly subcooled by the receiver (i.e., flash tank 10), thus reducing the amount of subcooling required to be produced by the condenser (i.e., outdoor heat exchanger 122) thereby slightly reducing the condenser charge and pressure required in the cooling mode.

In the cooling mode, the compressor 118 provides vaporized refrigerant at discharge pressure to the four-way reversing valve 124 via a conduit 152. If either or both of the indoor heat exchanger 120 and outdoor heat exchanger 122 include use of a fixed orifice or a capillary tube as the control device 128, 136, the required accumulator 142 may be fluidly coupled between the compressor 118 and the four-way reversing valve 124 along the conduit 174. The vapor refrigerant at discharge pressure travels through the conduit 152 and encounters the four-way reversing valve 124, which directs the vaporized refrigerant at discharge pressure generally toward the outdoor heat exchanger 122 along a conduit 154.

The vaporized refrigerant at discharge pressure enters the outdoor heat exchanger 122 and rejects heat, thereby changing state from a high pressure vapor to a liquid. In this manner, the outdoor heat exchanger 122 functions as a condenser in the cooling mode.

Once the vaporized refrigerant sufficiently changes state from a vapor to a liquid, the liquid refrigerant exits the outdoor heat exchanger 122 and flows through the check valve 134, bypassing the control device 136. The liquid refrigerant travels through the check valve 134 to the second port 44 of the flash tank 10 via a conduit 156. The liquid refrigerant enters the flash tank 10 at the second port 44 and is received generally within the bottom portion 16 of the shell 12.

The liquid refrigerant disposed within the inner volume 20 of the flash tank 10 is only permitted to reach a level approximately equal to one-third the total height of the shell 12, as the first port 22 acting as outlet port in the cooling mode is disposed at a height approximately equal to one-third the total height of the shell 12. Therefore, when liquid entering at the second port 44 acting as inlet port in the cooling mode reaches a height approximately equal to one-third the total height of the shell 12, the liquid encounters the first port 22 and exits the interior volume 20 of the flash tank 10 via the L-shaped elbow 26.

The entering liquid at the second port 44 does not separate into a sub-cooled liquid refrigerant and intermediate-pressure vapor as the solenoid valve 150 disposed along a conduit 158 extending generally between the outlet 54 of the vapor injection arrangement 50 and the vapor injection port 148 of the compressor 118 remains closed. Because the solenoid valve 150 remains closed, intermediate-pressure vapor is not permitted to escape from the inner volume 20 of the flash tank 10 and travel along the conduit 158 towards the compressor 118. Because the intermediate-pressure vapor is not permitted to travel along the conduit 158 and enter the compressor 118, liquid refrigerant entering the flash tank 10 is not permitted to expand into an intermediate-pressure vapor and a sub-cooled liquid refrigerant. Because the liquid refrigerant entering the flash tank 10 is not permitted to separate into an intermediate-pressure vapor and a sub-cooled liquid, the entering fluid merely resides within the bottom portion 16 of the shell 12, thereby causing the flash tank 10 to act as a receiver during the cooling mode.

When the liquid refrigerant disposed within the bottom portion 16 of the shell 12 reaches the first port 22, the liquid refrigerant enters the first port 22 and exits the shell 12 via the L-shaped elbow 26. The liquid refrigerant first encounters the second chamber 40 of the L-shaped elbow 26 and travels through the second chamber 40 until exiting the L-shaped elbow 26 via the first chamber 38 and fitting 34. Once the liquid refrigerant exits the flash tank 10 at the fitting 34, the liquid refrigerant travels along a conduit 160 disposed generally between the fitting 34 and the check valve 144. The liquid refrigerant encounters the check valve 144 and passes therethrough, thereby bypassing the control device 146.

Once the liquid refrigerant bypasses the control device 146 via the check valve 144, the liquid refrigerant travels along a conduit 162 extending generally between the check valve 144 and the check valve 126. The liquid refrigerant travels along the conduit 162 and engages the check valve 126 associated with the indoor heat exchanger 120.

The check valve 126 causes the liquid refrigerant to travel along a conduit 164 and engage the control device 128. The control device expands the liquid refrigerant prior to the liquid refrigerant reaching the indoor heat exchanger 120. If the control device 128 is a fixed orifice, the degree to which the fluid refrigerant is expanded prior to reaching the indoor heat exchanger 120 is fixed. However, if the control device 128 is one of a thermal expansion device or an electronic expansion device, the control device 128 may regulate the amount of expansion of the liquid refrigerant based on the demand for cooling.

The expanded refrigerant exits the control device 128 and enters the indoor heat exchanger 120 via conduits 166 and 168. Once the refrigerant enters the indoor heat exchanger 120, the refrigerant absorbs heat from the surroundings and changes state from a liquid into a gas. In this manner, the indoor heat exchanger 120 functions as an evaporator on the cooling mode.

Once the refrigerant has sufficiently changed state from a liquid to a gas, the refrigerant exits the indoor heat exchanger 120 and travels back to the four-way reversing valve 124 via a conduit 170. The four-way reversing valve 124 directs the vaporized refrigerant to a suction port 172 of the compressor 118 via a conduit 174.

In the heating mode, the four-way reversing valve reverses the flow of refrigerant within the heat pump 116 such that the indoor heat exchanger 120 functions as a condenser and the outdoor heat exchanger 122 functions as an evaporator. In operation, the compressor 118 supplies vaporized refrigerant at discharge pressure to the four-way reversing valve 124 via conduit 152. The four-way reversing valve directs the vaporized refrigerant at discharge pressure to the indoor heat exchanger 120 via conduit 170. The vaporized refrigerant at discharge pressure enters the indoor heat exchanger 120 and rejects heat, thereby changing state from a vapor to a liquid.

Once the refrigerant has sufficiently changed state from a high-pressure vapor to a liquid, the liquid refrigerant exits the indoor heat exchanger 120 via conduit 168 and engages the check valve 126. The check valve allows the liquid refrigerant to pass therethrough and travel generally towards the check valve 144 along conduit 162, thereby bypassing control device 128. The liquid refrigerant encounters the check valve 144 and is restricted from entering the fitting 34 of the flash tank 10 without first passing through the control device 146. The liquid engages the check valve 144 and is directed towards the control device 146 along a conduit 176. The liquid refrigerant is expanded by the control device 146 and is then directed to the fitting 34 of the flash tank 10 via conduits 160 and 178. The expanded refrigerant enters the inner volume 20 of the flash tank 10 via the fitting 34, the L-shaped elbow 26, and the first port 22. As described above, the velocity and turbulence of the incoming refrigerant is slowed due to the relationship of the second chamber 40 of the L-shaped elbow 26 and the tangential relationship of the first port 22 with the inner surface 24 of the shell 12.

Once the liquid refrigerant enters the inner volume 20 of the flash tank 10, the liquid refrigerant is expanded into a high-pressure vaporized refrigerant and a sub-cooled liquid refrigerant.

The sub-cooled liquid refrigerant is collected generally at the bottom portion 16 of the shell 12 while the intermediate-pressure vapor is collected generally near the top portion 14 of the shell 12.

The intermediate-pressure vapor is fed to the vapor injection port 148 of the compressor 118 via conduit 158. The vapor injection arrangement 50 provides the intermediate-pressure vapor to the vapor injection port 148 of the compressor 118 via outlet 54, conduit 158, and solenoid valve 150. The control device also may be controlled based on the demand for heating. If ambient outdoor temperatures are low, preferably below 25 degrees Fahrenheit, the solenoid valve 150 is required to more fully open and allow more intermediate-pressure vapor to enter the compressor 118 via vapor injection port 148. Conversely, if outdoor ambient temperatures are high, preferably above 45 degrees Fahrenheit, the solenoid valve 150 will restrict flow through the conduit 158 to restrict the amount of intermediate-pressure vapor received by the compressor 118 at the vapor injection port 148.

Solenoid valve 150 may also be pulse-width modulated as a function of outdoor temperature. For example, the solenoid valve 150 may be fully open to maximize the capacity of the heat pump at lower outdoor temperatures (i.e., at outdoor ambient temperature less than 25 degrees Fahrenheit) to reduce use of supplementary heaters (i.e., resistance electric heaters). Conversely, the solenoid valve 150 may be closed to minimize the capacity of the heat pump at higher outdoor ambient temperatures (i.e., at outdoor ambient temperatures above 45 degrees Fahrenheit) to reduce on/off cycling loss. The solenoid valve 150 may be pulse-width modulated when the outdoor ambient temperature is between 25 degrees Fahrenheit and 45 degrees Fahrenheit.

Providing the compressor 118 with intermediate-pressure vapor at the vapor injection port 148 reduces the amount of work required by the compressor 118 in producing vaporized refrigerant at discharge pressure. Specifically, because the intermediate-pressure vapor is at a lower pressure than discharge pressure, but at a higher pressure than suction pressure, the compressor is required to do less work in pressurizing the intermediate-pressure vapor to discharge pressure when compared to the work required in compressing vapor at suction pressure to discharge pressure.

The sub-cooled liquid refrigerant disposed within the bottom portion 16 of the shell 12 exits the flash tank 10 at the second port 44 and travels generally toward the check valve 134 along conduit 156. When the sub-cooled liquid refrigerant encounters the check valve 134, the check valve causes the sub-cooled liquid refrigerant to travel along a conduit 180 and engage the control device 136. The control device 136 expands the sub-cooled liquid refrigerant prior to the refrigerant entering the outdoor heat exchanger 122. Once the refrigerant is expanded by the control device 136, the expanded refrigerant travels along a pair of conduits 182, 184 and is received by the outdoor heat exchanger 122. The expanded refrigerant releases heat and therefore changes state from a liquid to a vapor. Once the refrigerant has sufficiently changed state from a liquid to a vapor, the vapor exits the outdoor heat exchanger 122 and travels to the four-way reversing valve 124 via conduit 154. Upon reaching the four-way reversing valve 124, the vapor then travels back to the suction port 172 of the compressor 118 via conduit 174 to begin the cycle anew.

The positioning of the L-shaped elbow 26 relative to the bottom portion 16 of the flash tank 10 allows the flash tank 10 to be used as a flash tank in the heating mode and as a receiver in the cooling mode. In the cooling mode, the flash tank 10 operates as a receiver and therefore basically allows the received refrigerant to pass through the flash tank 10 without expanding. Therefore, the lower the L-shaped elbow 26 is to the bottom portion 16 of the shell 12, the less refrigerant (i.e., charge) that is required within the system 116. However, for the heating mode, the flash tank 10 functions as a flash tank and separates the received refrigerant into an intermediate-pressure vapor and a sub-cooled liquid refrigerant. Therefore, the more refrigerant received by the flash tank 10, the more intermediate-pressure vapor and sub-cooled liquid refrigerant that can be produced.

If the flash tank 10 were solely used in a system having a heating mode, the L-shaped elbow 26 could be positioned substantially at a middle portion of the shell 12, generally equidistant from the bottom portion 16 and the top portion 14, to maximize the amount of sub-cooled liquid and intermediate-pressure vapor within the shell.

However, for heat pump systems functioning in both a heating mode and a cooling mode, such as heat pump 116, positioning the L-shaped elbow 26 at the middle of the shell 12 requires more refrigerant (i.e., charge) to be supplied to the heat pump 116 so that the entering refrigerant at the second port 44 in the cooling mode can sufficiently fill the inner volume 20 and reach the L-shaped elbow 26 and exit the shell 12.

In light of the foregoing, the L-shaped elbow 26 is positioned a distance away from the bottom of the flash tank 10 approximately equal to one-third a total height of the shell 12. This position allows the heat pump system 116 to include a lower charge in the cooling mode than would otherwise be required if the L-shaped elbow 26 were positioned at a higher point along the shell 12 (i.e., such as the midpoint of the shell 12) and allows the flash tank 10 to produce a sufficient amount of intermediate-pressure vapor for use by the vapor injection arrangement 50 during the heating mode.

High-efficiency heat pump systems tend to have much larger internal volume in the outdoor heat exchanger 122 than the indoor heat exchanger 120. Therefore, the minimum charge required is reduced and the charge requirement for the cooling and heating modes is balanced without the need for a "charge robbing" device such as an empty volume or tank that allows for removal of excess charge.

For the heat pump system 116, control devices 146 and 128, together with their check valves 144 and 126, can be replaced by a single bi-directional electronic expansion valve, preferably located at the indoor unit 120 at the same location as control device 128. With this arrangement, the fluid conduit 162 will contain liquid refrigerant in the cooling mode and expanded refrigerant in the heating mode.

For the heat pump system 116, the solenoid valve 150 may be open in the cooling mode to introduce a significant amount of liquid instead of vapor into the compressor 118 at a much higher injection pressure than the heating mode since the liquid is not expanded down to a lower pressure when entering the receiver (i.e., flash tank 10). This is commonly referred to as a "liquid injection" system instead of a vapor injection system. Liquid injection may be used at a high outdoor temperature to provide internal cooling to the compressor 118 as needed.

Figure 11:
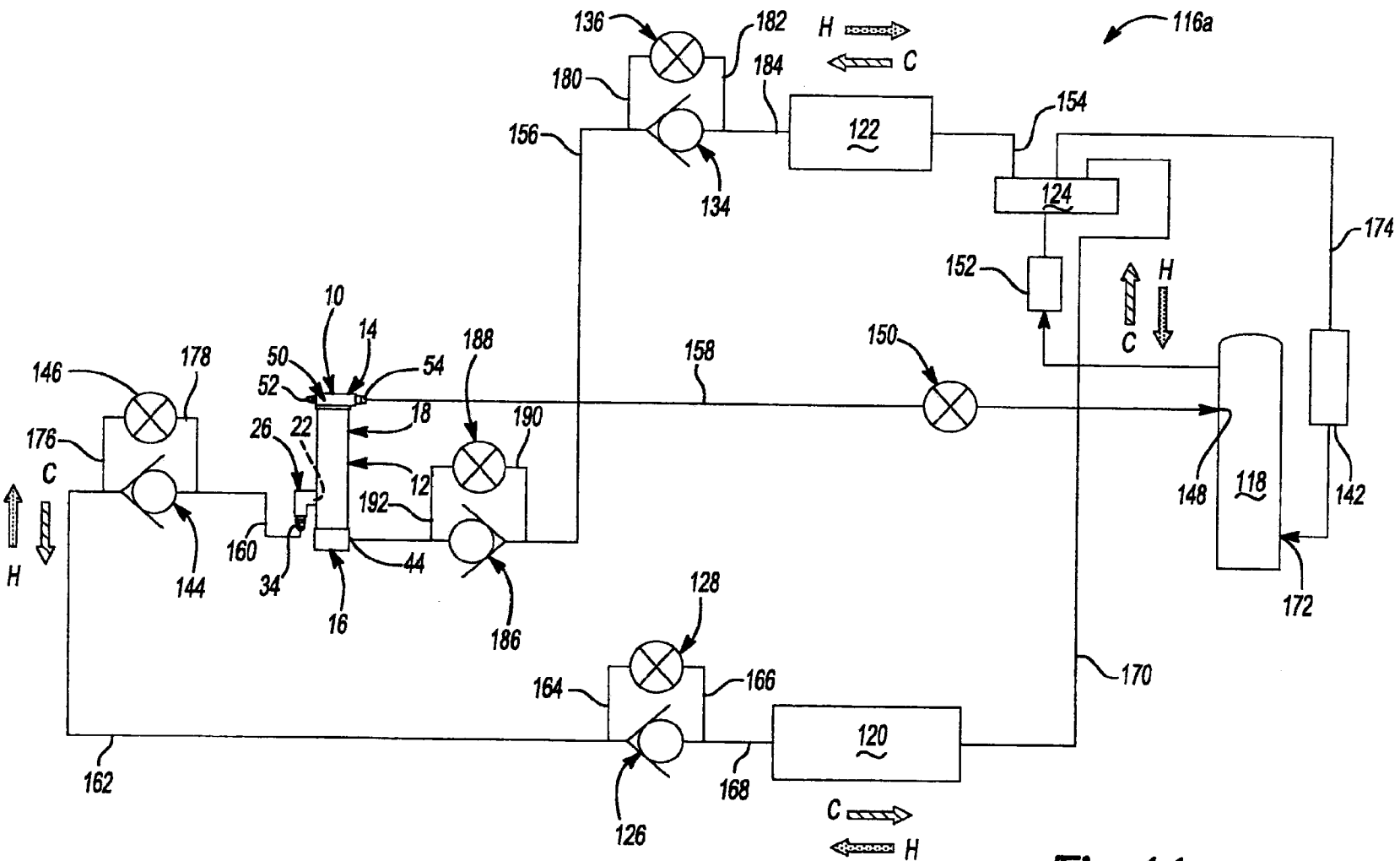
FIG. 11 is a schematic view of a heat pump system incorporating a flash tank.

With particular reference to FIG. 11, another heat pump system **116*a* is provided. In view of the substantial similarity in structure and function of the components associated with the heat pump system 116 with respect to the heat pump system 116*a***, like reference numerals are used hereinafter and in the drawings to identify like components, while like reference numerals containing letter extensions are used to identify those components that have been modified.

The heat pump system **116*a* is similar to the heat pump system 116, with the exception that the vapor injection arrangement 50 is used in both the heating mode and the cooling mode. In this arrangement, the solenoid valve 150 could be eliminated and injection to port 148 is dependent on whenever the compressor 118 is operating. To achieve this, a check valve 186 and a control device 188 are fluidly coupled between the second port 44 of the flash tank 10 and the check valve 134 and control device 136 of the outdoor heat exchanger 122, generally along conduit 156**.

In operation, the compressor 118 supplies vapor at discharge pressure to the four-way reversing valve 124 via conduit 152. If either of the indoor heat exchanger 120 or the outdoor heat exchanger 122 incorporates a fixed orifice for use as the control device 128, 136, an accumulator 142 may be required. Under such circumstances, the compressor 118 supplies vapor at discharge pressure to the four-way reversing valve 124 via conduit 152.

The four-way reversing valve 124, upon receiving the vaporized refrigerant at discharge pressure, directs the vaporized refrigerant at discharge pressure towards the outdoor heat exchanger 122 in the cooling mode. The vaporized refrigerant enters the outdoor heat exchanger 122 and is converted therein from a vapor to a liquid.

Once the vaporized refrigerant has been sufficiently converted from a vapor to a liquid, the liquid refrigerant exits the outdoor heat exchanger 122 along conduit 184 and passes through the check valve 134 and is directed toward the flash tank 10 via conduit 156. The liquid refrigerant travels along the conduit 156 and encounters the check valve 186. The check valve 186 causes the liquid refrigerant to travel along a conduit 190 and encounter the control device 188. The control device 188 may be one of a thermal expansion valve, an electronic expansion valve, or a fixed orifice, and serves to expand the liquid refrigerant prior to the liquid refrigerant entering the flash tank 10.

Upon expansion by the control device 188, the liquid refrigerant travels along conduits 192, 194 prior to being received by the flash tank 10. The expanded liquid refrigerant is received by the flash tank 10 at the second port 44 and is expanded within the inner volume 20 of the shell 12 into an intermediate-pressure vapor and a sub-cooled liquid refrigerant. The intermediate-pressure vapor is directed toward the vapor injection port 148 of the compressor 118 by the vapor injection arrangement 50.

The vapor injection arrangement 50 directs the intermediate-pressure vapor to the vapor injection port 148 of the compressor 118 via outlet 54, conduit 158, and solenoid valve 150 if used. The solenoid valve 150 may be controlled based on the demand for cooling and can be controlled as a function of outdoor ambient temperatures. For example, solenoid valve 150 can be turned off at a maximum outdoor temperature (125 degrees Fahrenheit) to reduce peak load on a utility power grid or turned on to allow the compressor 118 to provide a greater cooling effect at a high efficiency. Likewise, solenoid valve 150 can be turned on at the rated full-load outdoor ambient temperature (i.e., 95 degrees Fahrenheit) to increase the system rated nominal capacity (i.e., at full load) and turned off at lower outdoor temperature (i.e., 82 degrees Fahrenheit) to reduce capacity at part-load (i.e., a lower load) to increase system efficiency through reduced heat exchanger loading.

The sub-cooled liquid refrigerant disposed within the bottom portion 16 of the shell 12 exits the interior volume 20 via first port 22 and L-shaped elbow 26. The sub-cooled liquid refrigerant travels through the L-shaped elbow 26 and the fitting 34 generally toward the check valve 144 via conduit 160. The sub-cooled liquid refrigerant travels through the check valve 144, bypassing the control device 146, and continues along conduit 162 generally toward the check valve 126. The check valve 126 causes the sub-cooled liquid refrigerant to travel along conduit 164 and encounter the control device 128. The control device 128 expands the sub-cooled liquid refrigerant and directs the expanded refrigerant toward the indoor heat exchanger 120 via conduits 166 and 168.

Once the expanded refrigerant is within the indoor heat exchanger 120, the expanded refrigerant absorbs heat and in so doing, changes state from a liquid to a vapor. Once the refrigerant has sufficiently changed state from a liquid to a vapor, the vaporized refrigerant exits the indoor heat exchanger 120 and travels along conduit 170 generally towards the four-way reversing valve 124. The four-way reversing valve 124 receives the vaporized refrigerant and directs the vaporized refrigerant to the suction port 172 of the compressor 118 via conduit 174 to begin the process anew.

In the heating mode, the compressor 118 provides vapor at discharge pressure to the four-way reversing valve 124 via conduit 152. Again, the indoor heat exchanger 120 or the outdoor heat exchanger 122 includes a fixed orifice as the control device 128, 136, and accumulator 142 may be required. Under such circumstances, the compressor 118 provides vapor at discharge pressure to the four-way reversing valve 124 via conduit 152.

The four-way reversing valve 124 directs the vapor at discharge pressure toward the indoor heat exchanger 120 when in the heating mode. The vaporized refrigerant enters the indoor heat exchanger 120 and rejects heat, thereby changing phase from a high-pressure vapor to a liquid. Once the refrigerant has sufficiently changed phase from a vapor to a liquid, the liquid refrigerant exits the indoor heat exchanger 120 via conduit 168.

The exiting refrigerant travels along conduit 168 and encounters the check valve 126. The check valve 126 allows the liquid refrigerant to bypass the control device 128 and travel along conduit 162 generally toward the check valve 144. The check valve 144 directs the liquid refrigerant through conduit 176 to the control device 146. The control device 146 expands the liquid refrigerant prior to directing the liquid refrigerant to the flash tank 10.

The expanded refrigerant exits the control device 146 and travels to the fitting 34 of the L-shaped elbow 26 via conduits 178 and 160. The expanded refrigerant enters the flash tank 10 via the fitting 34, the L-shaped elbow 26, and the first port 22.

Once the expanded refrigerant enters the inner volume 20 of the flash tank 10, the refrigerant is expanded into an intermediate-pressure vapor and a sub-cooled liquid refrigerant. The intermediate-pressure vapor is supplied to the injection port 148 of the compressor 118 by the vapor injection arrangement 50. Specifically, the vapor injection arrangement 50 directs the intermediate-pressure vapor toward the injection port 148 of the compressor 118 via outlet 54, conduit 158, and solenoid valve 150. The solenoid valve 150 may be controlled based on outdoor ambient temperature, as described above.

The sub-cooled liquid refrigerant disposed generally within the bottom portion 116 of the shell 12 exits the flash tank 10 via the second port 44. The exiting sub-cooled liquid refrigerant travels toward the check valve 186 via conduit 194 and bypasses the control device 188. Once the sub-cooled liquid refrigerant has passed through the check valve 186, the sub-cooled liquid refrigerant travels along conduit 156 generally towards the check valve 134.

The check valve 134 causes the sub-cooled liquid refrigerant to travel along the conduit 180 and generally towards the control device 136. The control device 136 expands the sub-cooled liquid refrigerant prior to directing the sub-cooled liquid refrigerant to the outdoor heat exchanger 122. Once the refrigerant has been sufficiently expanded, the refrigerant is directed to the outdoor heat exchanger 122 via conduits 182 and 184. Once disposed within the outdoor heat exchanger 122, the liquid refrigerant absorbs heat and changes state from liquid to a vapor. Once the refrigerant has sufficiently changed state from a liquid to a vapor, the vaporized refrigerant is directed toward the four-way reversing valve 124 via conduit 154. The four-way reversing valve 124 directs the vaporized refrigerant toward the suction port 172 of the compressor 118 via conduit 174 to begin the cycle anew.

Figure 12:
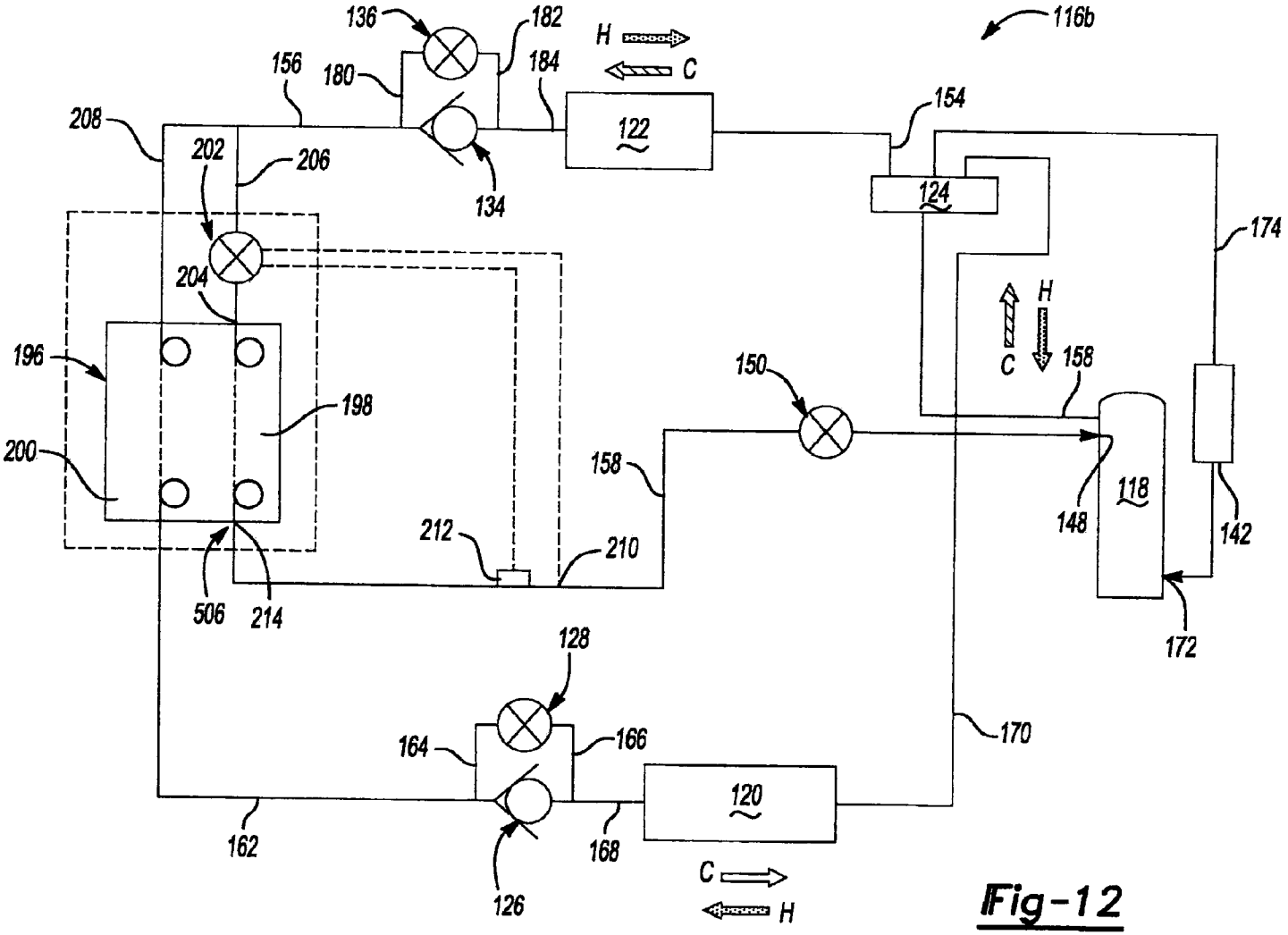
FIG. 12 is a schematic view of a heat pump system incorporating a plate heat exchanger.

With particular reference to FIG. 12, another heat pump system **116*b* is provided. In view of the substantial similarity in structure and function of the components associated with the heat pump system 116 with respect to the heat pump system 116*b***, like reference numerals are used hereinafter and in the drawings to identify like components, while like reference numerals containing letter extensions are used to identify those components that have been modified.

The heat pump system **116*b* is similar to the heat pump systems 116 and 116*a*, however, the flash tank 10 is replaced with a plate heat exchanger 196 for supplying vapor to the vapor injection port 148 of the compressor 118. This heat exchanger can be of a shell-and-tube or microchannel type, but the plate heat exchanger design is the most common and minimizes charge requirement. The plate heat exchanger 196 includes a vapor side 198 and a sub-cooled liquid side 200 and is fluidly coupled between the indoor heat exchanger 120 and the outdoor heat exchanger 122. A control device 202 is disposed at an inlet 204 of the vapor side 198 to expand liquid refrigerant prior to the liquid refrigerant entering the vapor side 198. The control device 202 in conjunction with the vapor side 198 creates a stream of intermediate-pressure vapor for use by a vapor injection arrangement 50*b*. The vapor injection arrangement 50*b* provides the intermediate-pressure vapor to the vapor injection port 148 of the compressor 118 to improve the overall efficiency and performance of the compressor 118**.

With continued reference to FIG. 12, operation of the heat pump system **116*b* will be described. In a cooling mode, the compressor 118 supplies vapor at discharge pressure to the four-way reversing valve 124 via conduit 152. If the indoor heat exchanger 120 or the outdoor heat exchanger 122 include a fixed orifice for the control devices 128, 136, an accumulator 142 may be required. Under such circumstances, the compressor 118 supplies vapor at discharge pressure to the four-way reversing valve 124 via conduit 152 and accumulator 142**.

The four-way reversing valve 124 directs the vapor at discharge pressure towards the outdoor heat exchanger 122. The outdoor heat exchanger 122 receives the high-pressure vapor from the four-way reversing valve 124 and causes the high-pressure vapor to release heat, thereby causing the vapor to change phase into a liquid. Once the refrigerant has sufficiently changed phase from a vapor to a liquid, the liquid refrigerant exits the outdoor heat exchanger 122 along conduit 184. The liquid refrigerant travels along conduit 184 and encounters the check valve 134, thereby bypassing the control device 136. The liquid refrigerant continues on conduit 184 through the check valve 134 and continues past the check valve 134 and into conduit 156.

The liquid refrigerant travels via conduit 156 generally towards the plate heat exchanger 196 and flows into a conduit 206 directing the liquid refrigerant toward the vapor side 198 of the plate heat exchanger 196 and also to a conduit 208 directing the liquid refrigerant to the sub-cooled liquid side 200 of the plate heat exchanger 196.

The liquid refrigerant disposed within the conduit 206 encounters the control device 202 located upstream of the inlet 204 of the vapor side 198. The control device 202 may be a thermal expansion valve, an electronic expansion valve, or a fixed orifice. If the control device 202 is a thermal expansion valve, a pressure tap 210 and a bulb may be positioned generally downstream of an outlet 214 of the vapor side 198, generally between outlet 214 and the vapor injection port 148 of the compressor 118. The pressure tap 210 and bulb 212 are used in controlling the thermal expansion device 202 located upstream of the inlet 204 to the vapor side 198.

The liquid refrigerant disposed within conduit 206 is received by the control device 202 and is expanded prior to reaching the inlet 204 of the vapor side 198. Once the liquid refrigerant has been sufficiently expanded by the control device 202, the expanded refrigerant enters the vapor side 198 of the plate heat exchanger 196 at the inlet 204. Once in the vapor side 198, the liquid refrigerant extracts heat associated with the liquid refrigerant flowing through conduit 208 in the liquid side 200 of the plate heat exchanger 196.

In this manner, as the liquid refrigerant flows through the conduit 208 in the liquid side 200 of the plate heat exchanger 196, heat is lost to the vapor side 198 of the plate heat exchanger 196, thereby converting the liquid refrigerant entering the liquid side 200 of the plate heat exchanger 196 into sub-cooled liquid refrigerant. The heat absorbed from the liquid refrigerant passing through the liquid side 200 of the plate heat exchanger 196 is absorbed by the liquid refrigerant entering the vapor side 198 of the plate heat exchanger 196 causing the liquid within the vapor side 198 to expand and create a flow of intermediate-pressure vapor.

The intermediate-pressure vapor exits the vapor side 198 of the plate heat exchanger 196 at the outlet 214 and travels along conduit 158 to the vapor injection port 148 of the compressor 118. As described previously with respect to heat pump systems 116 and 116*a*, the intermediate-pressure vapor received by the compressor 118 at the vapor injection port 148 increases the ability of the compressor 118 to produce vapor at the discharge pressure. Therefore, by producing the intermediate-pressure vapor at the plate heat exchanger 196 and supplying the intermediate-pressure vapor to the compressor 118, the overall efficiency of the compressor 118 and system 116*b* is improved.

The solenoid valve 150 is disposed generally between the outlet 214 of the vapor side 198 and the vapor injection port 148 of the compressor 118 and controls the amount of intermediate-pressure vapor received by the vapor injection port 148, as described above.

The sub-cooled liquid created by the liquid side 200 of the plate heat exchanger 196 exits the plate heat exchanger and travels along a conduit 162 generally towards the check valve 126. The check valve 126 forces the sub-cooled liquid refrigerant to travel along a conduit 164 and encounter the control device 128. The control device 128 expands the liquid refrigerant prior to the refrigerant entering the indoor heat exchanger 120. Once the refrigerant has been sufficiently expanded by the control device 128, the refrigerant travels to the indoor heat exchanger 120 via conduits 166 and 168. The sub-cooled liquid refrigerant received in the indoor heat exchanger 120 rejects heat and in so doing, changes phase from a liquid to a vapor. Once the refrigerant has been sufficiently converted from a liquid to a vapor, the vaporized refrigerant exits the indoor heat exchanger 120 and travels towards the four-way reversing valve 124 via conduit 170. The four-way reversing valve 120 directs the vaporized refrigerant toward the suction port 172 of the compressor 118 via conduit 174 to begin the cycle anew.

In the heating mode, the compressor 118 produces vapor at the discharge pressure and directs the vapor toward the four-way reversing valve 124 via conduit 152. Again, if the indoor heat exchanger 120 or the outdoor heat exchanger 122 includes a fixed orifice as the control device 128, 136, an accumulator 142 may be required. Under such circumstances, the compressor 118 provides vapor at discharge pressure to the four-way reversing valve via conduit 152.

The four-way reversing valve 124 directs the vapor at discharge pressure towards the indoor heat exchanger 120 via conduit 170. The indoor heat exchanger 120 receives the high pressure vapor from the four-way reversing valve 124 and causes the high pressure vapor to reject heat, thereby causing the refrigerant to change phase from a vapor to a liquid. Once the refrigerant has sufficiently changed phase from a vapor to a liquid, the liquid refrigerant exits the indoor heat exchanger 120 and travels towards the check valve 126 via conduit 168.

The check valve allows the liquid refrigerant to bypass the control device 128 and continue on towards the plate heat exchanger 196 via conduit 162. The liquid refrigerant travels along conduit 162 and is received by the liquid side 200 of the plate heat exchanger 196. The liquid refrigerant travels through the liquid side 200 of the plate heat exchanger 196 via conduit 208. Once the liquid refrigerant encounters conduit 208, the refrigerant travels through conduit 208 and into conduit 206.

The liquid refrigerant received in conduit 206 encounters the control device 202 and is expanded by the control device 202 once therein. The expanded liquid refrigerant exits the control device 202 and enters the vapor side 198 of the plate heat exchanger 196 at the inlet 204.

The vapor side 198 of the plate heat exchanger 196 causes the expanded liquid refrigerant therein to absorb heat from the refrigerant passing through the liquid side 200 of the plate heat exchanger 196. In so doing, the refrigerant passing through the vapor side 198 is converted into an intermediate-pressure vapor and the refrigerant passing through the liquid side 200 is converted into a sub-cooled liquid refrigerant. In this arrangement, the vapor side 198 and liquid side 200 include a counter flow configuration in the heating mode and a parallel flow configuration in cooling mode.

The intermediate-pressure vapor exits the vapor side 198 of the plate heat exchanger 196 at the outlet 214 and is directed by the vapor injection arrangement 50*b* towards the vapor injection port 148 of the compressor 118. The intermediate-pressure vapor travels along conduit 158 and through the solenoid valve 150 prior to reaching the vapor injection port 148 of the compressor 118.

In the heating mode, as the outdoor ambient temperature falls, the solenoid valve 150 allows more intermediate-pressure vapor to reach the vapor injection port 148 of the compressor 118. Allowing more intermediate-pressure vapor to reach the compressor 118 improves the ability of the compressor 118 to produce vapor at the discharge pressure. Allowing the compressor 118 to produce more vapor at discharge pressure improves the ability of the heat pump system 116*b* in producing heat, and therefore improves the overall performance and efficiency of the system 116*b*.

The sub-cooled liquid refrigerant created by the liquid side 200 of the plate heat exchanger 196 travels along conduit 208 and conduit 156 generally towards the check valve 134. The check valve 134 causes the sub-cooled liquid refrigerant to travel along conduit 180 and encounter control device 136. The control device 136 expands the sub-cooled liquid refrigerant prior to the sub-cooled liquid refrigerant entering the outdoor heat exchanger 122. Once the sub-cooled liquid refrigerant has been sufficiently expanded by the control device 136, the expanded refrigerant travels into the outdoor heat exchanger 122 via conduits 182 and 184.

The outdoor heat exchanger 122 receives the expanded refrigerant and causes the refrigerant to absorb heat and change phase from a liquid to a vapor. Once the refrigerant has been sufficiently converted from a liquid to a vapor, the vaporized refrigerant exits the outdoor heat exchanger 122 and travels along conduit 154 generally towards the four-way reversing valve 124. The four-way reversing valve 124 directs the vaporized refrigerant to the suction port 172 of the compressor 118 via conduit 174 to begin the process anew.

Figure 13:
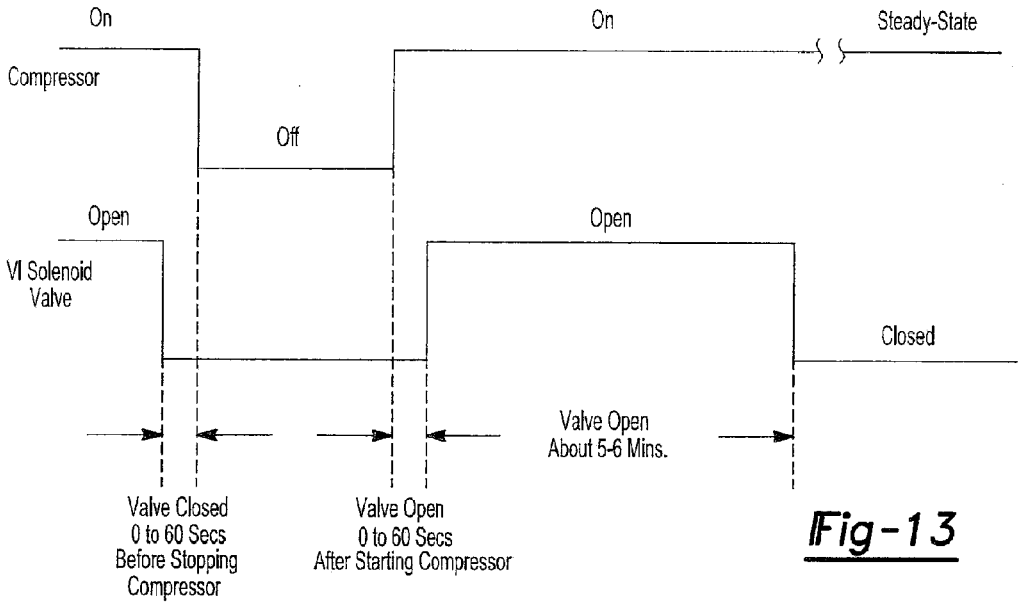
FIG. 13 is a schematic diagram illustrating a control scheme for a vapor injection system.
Figure 14:
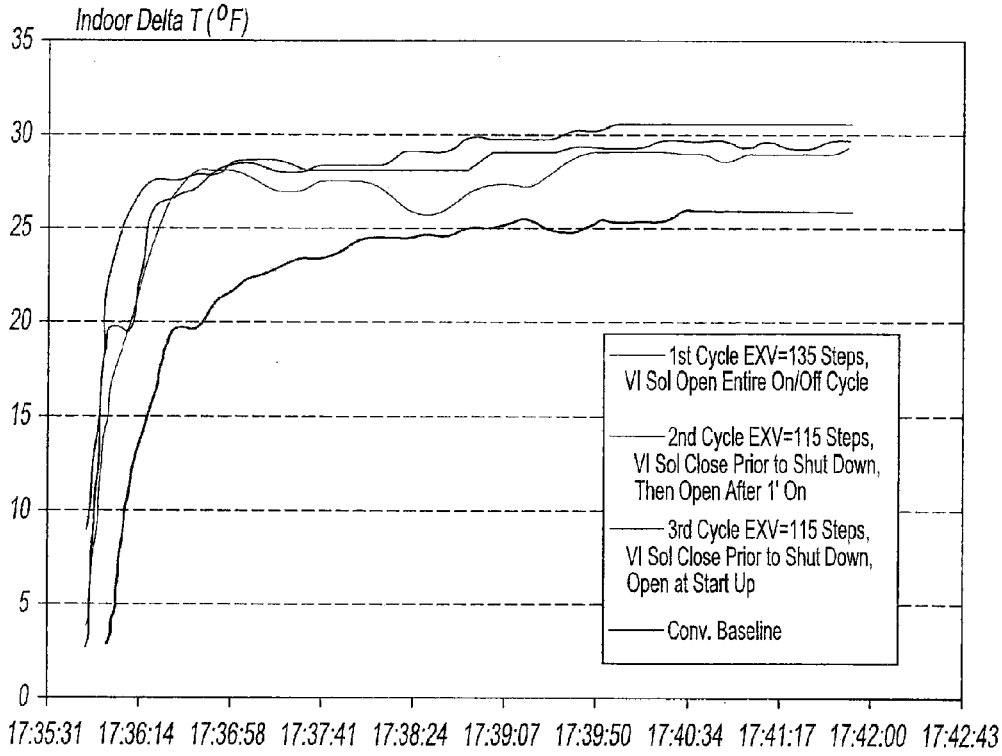
FIG. 14 is a graphical representation of indoor temperature change achieved variations of the control scheme of FIG. 13.

With particular reference to FIGS. 13 and 14, in any of the foregoing heat pump systems 116, 116*a* and 116*b*, ceasing operation of the respective systems 116, 116*a*, 116*b* may cause transient flow of refrigerant within the systems 116, 116*a*, 116*b*. For example, with respect to heat pump system 116, when operation of the compressor 118 is stopped and the control valve 150 is left open, migration of refrigerant generally from the flash tank 10 to the compressor 118 occurs until the refrigerant in the system 116 reaches a steady state condition. Similarly, if the control device 136 associated with the outdoor heat exchanger 122 is left open, refrigerant disposed generally between the flash tank 10 and the outdoor heat exchanger 122 is also in a transient state and may migrate to the suction port 172 of the compressor 118 until the refrigerant within the system reaches a steady state condition (i.e., equalized).

While the following technique can be used to prevent migration of refrigerant in any of the foregoing heat pump systems 116, 116*a*, or 116*b*, the following procedure will be described with respect to heat pump system 116*a*, as heat pump system 116*a* includes vapor injection in both the heating mode and the cooling mode. When a shutdown of the compressor 118 is imminent due to achieving a desired indoor temperature (i.e., heating or cooling), one, or both of, the control devices 136, 150 may be closed to prevent refrigerant migration within the heat pump system 116*a*.

The control devices 136, 150 may be closed a predetermined amount of time prior to shut down of the compressor 118 to avoid refrigerant migration. By closing the solenoid valve 150 a predetermined amount of time prior to shut down of the compressor 118, migration of refrigerant from the upper portion 14 of the flash tank 10 to the vapor injection port 148 of the compressor 118 is prevented. Similarly, by closing the control device 136 a predetermined amount of time prior to shut down of the compressor 118, migration of refrigerant from the outdoor heat exchanger 122 to the suction port 172 of the compressor 118 is prevented.

Preventing migration of refrigerant through the control devices 136 and 150 and into the compressor 118 protects the compressor 118 from a flooded start condition. Specifically, if the control devices 136 and 150 remain open when the compressor 118 is shut down, the refrigerant within the system 116*a* is allowed to migrate within the system 116*a* and may enter the compressor 118. When the compressor 118 is started again, excess refrigerant located within the compressor 118 may include liquid refrigerant, which may cause harm to the compressor 118.

With the control devices 136 and 150 in the closed position, the compressor 118 may be safely started as refrigerant is prevented from migrating into the compressor 118. Upon start up of the compressor 118, the control devices 136 and 150 may remain in the closed position for a pre-determined amount of time to allow the refrigerant to fill the flash tank 10 and outdoor heat exchanger 122 and stabilize before opening the respective control devices 136 and 150.

As described above, the control devices 136 and 150 are closed a predetermined amount of time leading up to system shut down and remain closed a predetermined amount of time following start up of the system 116*a*. In one exemplary embodiment, the predetermined time period may be substantially equal to zero to sixty seconds such that the control devices 136 and 150 are closed approximately zero to sixty seconds prior to the system 116*a* shutting down and are opened zero to sixty seconds following start up of the system 116*a*. While a fixed or straight time (i.e., zero to sixty seconds) is described, the predetermined time period may be based on performance of the system 116*a* and/or the compressor 118. Specifically, the predetermined time period could be based on the discharge line temperature or liquid level of the compressor 118, which is indicative of the compressor and system performance.

Once the solenoid valve 150 is opened, intermediate-pressure vapor is supplied to the compressor 118 at the vapor injection port 148. As described above, such vapor injection improves the ability of the compressor 118 to provide vapor and discharge pressure. The solenoid valve 150 may remain in the open state indefinitely to continuously provide the compressor 118 with improved performance, or the solenoid valve 150 may alternatively be selectively closed once the system 116*a* reaches steady state. In one exemplary embodiment, the system 116*a* reaches steady state approximately 10 minutes after the solenoid valve 150 is opened and intermediate-pressure vapor is supplied to the compressor 118.

Determining how long the solenoid valve 150 remains in the open state, thereby providing intermediate-pressure vapor to the compressor 118, may be based on ambient outdoor conditions. For example, if the system 116*a* is running in the cooling mode, intermediate-pressure vapor will be supplied to the compressor 118 for a longer period of time at higher outdoor ambient temperatures. Conversely, when outdoor ambient temperatures are low, and the system 116*a* is running in the cooling mode, less intermediate-pressure vapor may be supplied to the compressor 118. By controlling the time in which the solenoid valve 150 remains open, the amount of intermediate-pressure vapor supplied to the compressor 118 may be controlled. Controlling the supply of intermediate-pressure vapor supplied to the compressor 118 can effectively tailor the output of the compressor 118 to match demand, which as described above, may be based on outdoor ambient temperatures.

Figure 15:
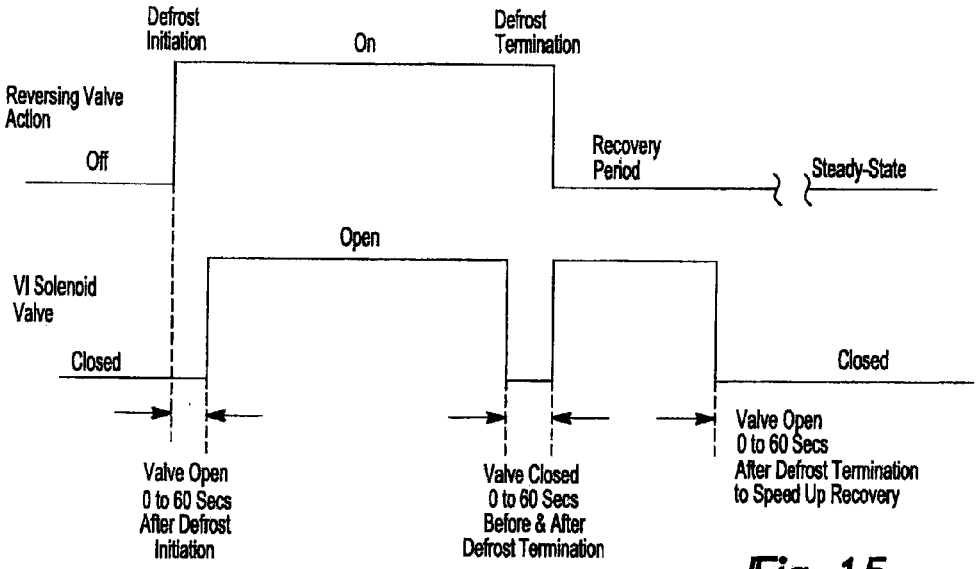
FIG. 15 is a schematic diagram illustrating a defrost control scheme.
Figure 16:
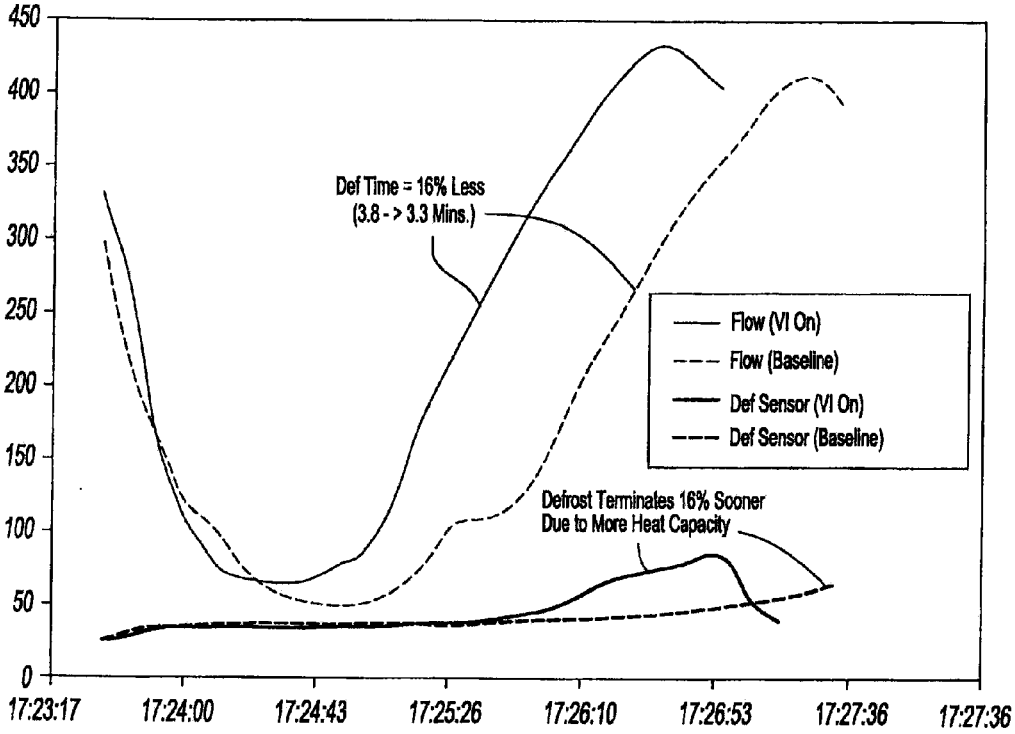
FIG. 16 is a graphical representation of flow rate through a heat exchanger achieved using the control scheme of FIG. 13.

With particular reference to FIGS. 15 and 16, regulating operation of the solenoid valve 150 may also improve performance of a defrost cycle of any of the systems 116, 116*a*, and 116*b*. While the following defrost control scheme may be used with any of the foregoing systems 116, 116*a*, and 116*b*, the defrost control scheme will be described in relation to control system 116*a*.

In operation, the vapor injection arrangement 50 is used to provide a defrost cycle with a capacity boost to allow the system 116*a* to defrost the outdoor heat exchanger 122 when operating as an evaporator in the heating mode below freezing ambient temperatures. In operation, when a defrost condition is determined, a signal is sent to the four-way reversing valve 124 to reverse flow and direct vapor at discharge pressure to the heat exchanger 122 that is experiencing the frost condition. The vapor at discharge pressure, once disposed within the heat exchanger 122 experiencing the frost condition, changes phase from a vapor to a liquid and in so doing releases heat. Releasing heat melts the frost disposed on the heat exchanger 122 and allows the heat exchanger 122 to return an essentially frost-free condition.

During the defrost cycle, the vapor injection arrangement 50 may be used to supply the compressor 118 with intermediate-pressure vapor to improve the ability of the compressor 118 to provide vapor at discharge pressure. Improving the ability of the compressor 118 to provide vapor at discharge pressure essentially boosts the heat capacity rejected into the heat exchanger 122 experiencing the frost condition and therefore improves the ability of the system 116*a* to eliminate frost faster on the respective heat exchanger 122.

While providing vapor at intermediate-pressure to the compressor 118 improves the ability of the system 116*a* to remove frost from one of the heat exchangers 122, control of the solenoid valve 150 helps prevent migration of liquid into the compressor 118 during reversing of the four-way reversing valve 124. Specifically, before the four-way reversing valve 124 is switched to direct vapor at discharge pressure towards the heat exchanger 122 experiencing the frost condition, the solenoid valve 150 is closed, thereby presenting intermediate-pressure vapor from reaching the vapor injection port 148 of the compressor 118 during reversing. The four-way reversing valve 124 may be closed for a predetermined amount of time leading up to reversal of the four-way reversing valve 124. Therefore, as flow is reversed between the heat exchangers 120, 122, any intermediate-pressure vapor that mixes with sub-cooled liquid refrigerant or incoming liquid refrigerant within the flash tank 10 is prevented from reaching the vapor injection port 148 of the compressor 118. As described above, preventing such liquid injection into the compressor 118 protects the compressor 118, and therefore improves the overall performance of the system 116*a*.

The solenoid valve 150 remains closed for the predetermined time to allow the refrigerant to change flow direction within the system 116*a* between the respective heat exchangers 120, 122. In one exemplary embodiment, the predetermined time period may be approximately equal to about zero to sixty seconds. While zero to sixty seconds is one exemplary embodiment, the predetermined time period may depend on the volume of refrigerant disposed within the system 116*a* and/or the sizes of the respective heat exchangers 120, 122 (i.e., coil size, etc.).

Following the predetermined time period, the solenoid valve 150 is opened once again to allow intermediate-pressure vapor to reach the vapor injection port 148 of the compressor 118. As previously described, providing the compressor 118 with intermediate-pressure vapor essentially boosts the heat capacity rejected at the heat exchanger 122 experiencing frost and therefore decreases the amount of time required to fully defrost the heat exchangers 122 experiencing the frost condition.

To terminate the defrost cycle, the system 116*a* reverses flow such that vapor at discharge pressure is directed away from the defrosted heat exchanger 122 and toward the indoor heat exchanger 120. Prior to the four-way reversing valve 124 changing the direction of flow of refrigeration within the system 116*a*, the solenoid valve 150 is closed again. The solenoid valve 150 is closed a predetermined time period leading to the termination of the defrost cycle to prevent liquid refrigerant from reaching the compressor 118. As described above with regard to initiation of the defrost cycle, when the four-way reversing valve 124 changes the direction of flow of refrigerant within the system 116*a*, the liquid refrigerant entering the flash tank 10 may mix with the sub-cooled liquid refrigerant and intermediate-pressure vapor disposed within the interior volume 20 of the flash tank 10 and therefore may be drawn into the compressor 118 at the vapor injection port 148, causing damage to the compressor 118. Therefore, prior to the four-way reversing valve 124 changing the direction of flow of refrigerant within the system 116*a*, the solenoid valve 150 is closed to prevent any liquid refrigerant from reaching the vapor injection port 148 of the compressor 118.

The solenoid valve 150 remains closed for a predetermined time period following termination of the defrost cycle. In one exemplary embodiment, the predetermined time period is approximately equal to zero to sixty seconds to allow the refrigerant within the system 116*a* to reach a steady state flow condition. The predetermined time period may be based on the volume of refrigerant disposed within the system 116*a* and/or the size of the respective heat exchangers 120, 122.

Figure 17:
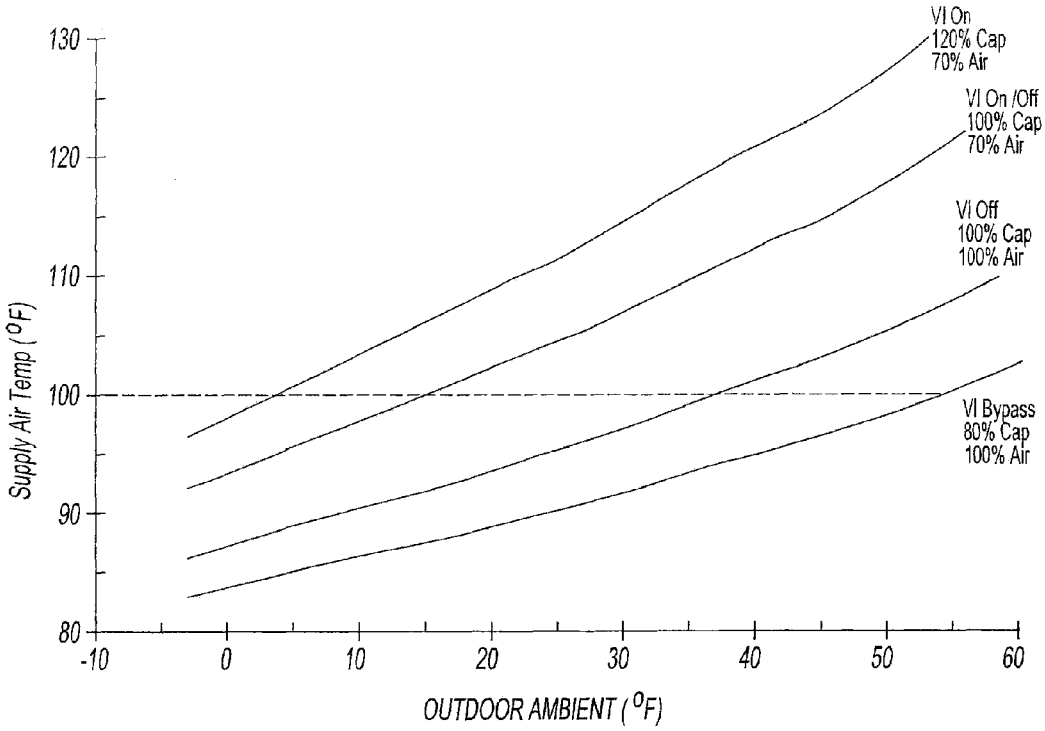
FIG. 17 is a graphical representation of a supply air temperature versus outdoor ambient temperature.
Figure 18:
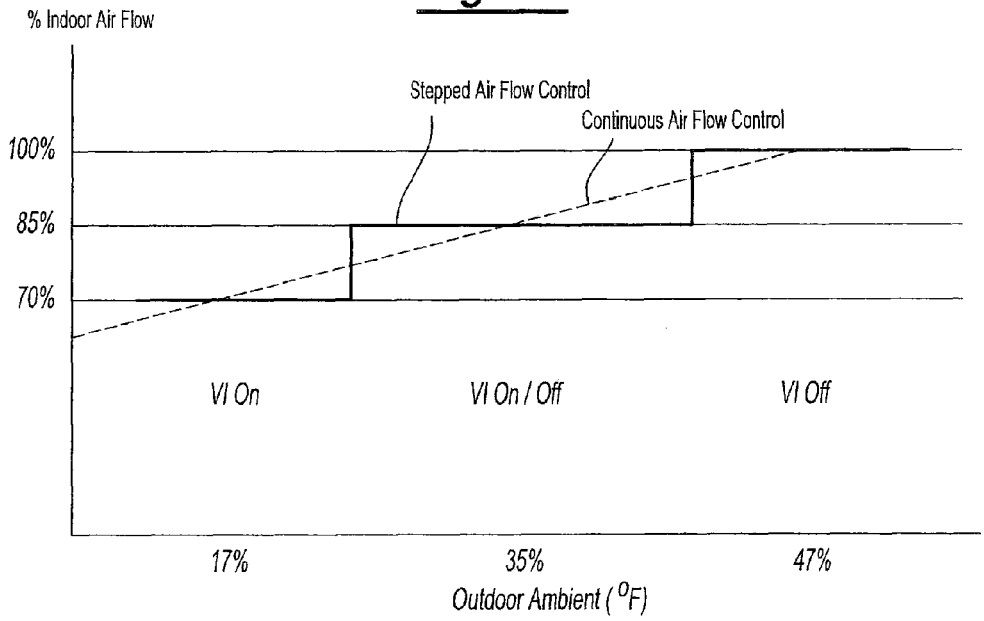
FIG. 18 is a graphical representation of percent indoor air flow versus outdoor ambient temperature.

The vapor injection system 50 may also be optimized in conjunction with a variable-speed blower serving the indoor heat exchanger 120 to increase hotter supply air in heating mode and enhanced dehumidification in cooling mode (FIGS. 17 and 18). The blower speed can be varied based on the solenoid valve 150 being open or closed.

What is claimed is:

1. A flash tank comprising:

a shell including an inner volume; and a first port in fluid communication with said inner volume and positioned relative to a surface of said inner volume such that fluid flows between said first port and said inner volume in a direction that is substantially tangent to said surface.

2. The flash tank of claim 1, wherein said first port is formed through a middle portion of said shell.

3. The flash tank of claim 1, wherein said first port is spaced apart from a bottom portion of said shell by a distance between approximately one-third and one-half of a total height of said shell.

4. The flash tank of claim 1, wherein said first port includes a first portion and a second portion cooperating to define a substantially L-shape.

5. The flash tank of claim 4, wherein said first portion includes an expansion volume to slow down a velocity of fluid entering said shell.

6. The flash tank of claim 1, further comprising internal baffles disposed within said shell.

7. The flash tank of claim 6, wherein said internal baffles are formed substantially perpendicular to a longitudinally extending surface of said shell.

8. The flash tank of claim 6, wherein said internal baffles are formed at an angle relative to a longitudinally extending surface of said shell.

9. The flash tank of claim 6, wherein said internal baffles include at least one through hole.

10. The flash tank of claim 6, wherein said internal baffles are positioned relative to said first port to receive fluid directly from said first port.

11. The flash tank of claim 1, further comprising a second port disposed proximate to a bottom portion of said shell, said second port being in fluid communication with said inner volume.

12. The flash tank of claim 1, further comprising a disk disposed within said shell to separate a liquid portion of said shell from a vapor portion of said shell.

13. The flash tank of claim 12, wherein said disk is a top surface of an internal shell disposed within said shell.

14. The flash tank of claim 12, wherein said disk is spaced apart from a bottom portion of said shell by a distance approximately equal to two thirds of a total height of said shell.

15. The flash tank of claim 12, wherein said disk includes at least one aperture to allow fluid communication between said liquid portion and said vapor portion.

16. The flash tank of claim 12, wherein said disk includes a tube extending from a top surface thereof and into said vapor potion.

17. The flash tank of claim 12, further comprising a recirculation tube formed through a middle portion of said shell to receive liquid from said liquid portion when said liquid portion exceeds a predetermined level within said shell.

18. The flash tank of claim 17, wherein said recirculation tube is fluidly coupled to a second port in fluid communication with said inner volume.

19. The flash tank of claim 1, further comprising a recirculation tube formed through a middle portion of said shell to remove liquid from said shell when said liquid reaches a predetermined level within said shell.

20. The flash tank of claim 19, wherein said recirculation tube is fluidly coupled to a second port in fluid communication with said inner volume.

21. The flash tank of claim 1, further comprising a sight glass disposed in said shell for viewing a fluid level within said shell.

22. The flash tank of claim 1, further comprising a liquid level sensor in communication with said inner volume and determining a fluid level within said shell.

23. The flash tank of claim 1, wherein said shell includes a height-to-diameter aspect ratio between approximately four and six.

24. A flash tank comprising:

a shell including an inner volume and having a height-to-diameter aspect ratio between approximately four and six;

a first port in fluid communication with said inner volume and operable as an inlet in a first mode and as an outlet in a second mode; and a second port in fluid communication with said inner volume and operable as an outlet in said first mode and as an inlet in said second mode;

wherein said first port is formed tangentially to an inner surface of said shell.

25. The flash tank of claim 24, wherein said first port is formed through a middle portion of said inner volume disposed between top and bottom portions of said inner volume.

26. The flash tank of claim 25, wherein said first port is spaced apart from said bottom portion by a distance approximately equal to one third or no more than half of a total height of said shell.

27. The flash tank of claim 24, wherein said first port includes a first portion formed perpendicular to said shell and a second portion formed substantially parallel to said shell such that said first portion and said second portion cooperate to define a substantially L-shape.

28. The flash tank of claim 27, wherein said first portion includes an expansion volume to slow down a velocity of fluid entering said shell.

29. The flash tank of claim 24, further comprising internal baffles disposed within said shell.

30. The flash tank of claim 29, wherein said internal baffles are formed substantially perpendicular to a middle portion of said inner volume, said middle portion disposed between top and bottom portions of said inner volume.

31. The flash tank of claim 29, wherein said internal baffles are formed at an angle relative to a middle portion of said inner volume, said middle portion disposed between top and bottom portions of said inner volume.

32. The flash tank of claim 29, wherein said internal baffles include at least one through hole.

33. The flash tank of claim 29, wherein said internal baffles are positioned relative to said first port to receive fluid directly from said first port.

34. The flash tank of claim 24, wherein said second port is disposed proximate to a bottom portion of said shell.

35. The flash tank of claim 24, further comprising a disk disposed within said shell to separate a liquid portion of said shell from a vapor portion of said shell.

36. The flash tank of claim 35, wherein said disk is a top surface of an internal shell disposed within said shell.

37. The flash tank of claim 35, wherein said disk is spaced apart from a bottom portion of said inner volume by a distance approximately equal to two-thirds of a total height of said shell.

38. The flash tank of claim 35, wherein said disk includes at least one aperture to allow fluid communication between said liquid portion and said vapor portion.

39. The flash tank of claim 35, wherein said disk includes a tube extending from a top surface thereof and into said vapor potion.

40. The flash tank of claim 35, further comprising a recirculation tube formed through a middle portion of said inner volume to receive liquid from said liquid portion when said liquid portion exceeds a predetermined level within said shell.

41. The flash tank of claim 40, wherein said recirculation tube is fluidly coupled to said second port.

42. The flash tank of claim 24, further comprising a recirculation tube formed through a middle portion of said inner volume to remove liquid from said shell when said liquid reaches a predetermined level within said shell.

43. The flash tank of claim 42, wherein said recirculation tube is fluidly coupled to said second port.

44. The flash tank of claim 24, further comprising a sight glass formed through said shell for viewing a predetermined fluid level within said shell.

45. The flash tank of claim 24, further comprising a liquid level sensor for determining a fluid level within said shell.

* * * * *

UNITED STATES PATENT AND TRADEMARK OFFICE

CERTIFICATE OF CORRECTION

PATENT NO. : 8,505,331 B2
APPLICATION NO. : 13/032202
DATED : August 13, 2013
INVENTOR(S) : Hung M. Pham et al.

It is certified that error appears in the above-identified patent and that said Letters Patent is hereby corrected as shown below:

| | |
|---|---|
| Title Page 2, Column 2, Item 56 Other Publications, Line 1 | Delete "Intellectual Propety" and insert --Intellectual Property--. |

In the Specification

| | |
|---|---|
| Column 3, Line 19 | Delete "potion" and insert --portion--. |
| Column 4, Line 36 | Delete "monobloc" and insert --monoblock--. |
| Column 5, Line 60 | Delete "side" and insert --outer--. |
| Column 6, Line 11 | Delete "fitting" and insert --elbow--. |
| Column 6, Line 37 | Delete "interior" and insert --inner--. |
| Column 6, Line 58 | Delete "interior" and insert --inner--. |
| Column 8, Line 47 | Delete "78" and insert --76--. |
| Column 10, Line 24 | Delete "portion" and insert --port--. |
| Column 10, Line 61 | Delete "18" and insert --12--. |
| Column 10, Line 62 | Delete "18" and insert --12--. |
| Column 10, Line 65 | Delete "18" and insert --12--. |
| Column 11, Line 25 | Delete "circuit" and insert --system--. |
| Column 11, Line 46 | After "40", insert --of--. |
| Column 12, Line 45 | Delete "inner" and insert --indoor--. |
| Column 12, Line 46 | Delete "four way" and insert --four-way--. |
| Column 13, Line 30 | Delete "44" and insert --42--. |
| Column 13, Line 47 | Before "injection", insert --vapor--. |
| Column 14, Line 27 | Delete "44" and insert --42--. |
| Column 14, Line 29 | Delete "44" and insert --42--. |
| Column 14, Line 37 | Delete "44" and insert --42--. |
| Column 14, Line 40 | Delete "interior" and insert --inner--. |
| Column 14, Line 42 | Delete "44" and insert --42--. |
| Column 15, Line 38 | After "pump", insert --system--. |
| Column 16, Line 50 | Delete "44" and insert --42--. |

Signed and Sealed this
Twenty-fourth Day of June, 2014

Michelle K. Lee

Michelle K. Lee
*Deputy Director of the United States Patent and Trademark Office*

| | |
|---|---|
| Column 17, Line 23 | After “pump”, insert --system--. |
| Column 17, Line 26 | After “pump”, insert --system--. |
| Column 17, Line 27 | Delete “44” and insert --42--. |
| Column 17, Line 30 | After “forgoing”, insert --discussion--. |
| Column 17, Line 50 | Delete “indoor unit” and insert --indoor heat exchanger--. |
| Column 18, Line 12 | Delete “44” and insert --42--. |
| Column 18, Line 45 | Delete “44” and insert --42--. |
| Column 19, Line 2 | Delete “interior” and insert --inner--. |
| Column 19, Line 28 | Delete “device” and insert --devices--. |
| Column 19, Line 64 | Delete “116” and insert --16--. |
| Column 19, Line 65 | Delete “44” and insert --42--. |
| Column 24, Line 60 | Delete “control” and insert --heat pump--. |
| Column 25, Line 19 | After “from”, delete “one of”. |
| Column 26, Line 4 | Delete “interior” and insert --inner--. |

In the Claims

| | |
|---|---|
| Column 26, Line 42 | In claim 4, delete “L-shape” and insert --L-shaped elbow--. |
| Column 28, Line 2 | In claim 27, delete “L-shape” and insert --L-shaped elbow--. |